US007617583B2

(12) United States Patent
Takahashi et al.

(10) Patent No.: US 7,617,583 B2
(45) Date of Patent: Nov. 17, 2009

(54) METHOD FOR PRODUCING HOT-DIP COATED METAL BELT

(75) Inventors: Hideyuki Takahashi, Hiroshima (JP); Yoshikazu Suzuki, Hiroshima (JP); Munehiro Ishioka, Hiroshima (JP); Fumio Fujita, Chiba (JP); Yoichi Miyakawa, Hiroshima (JP); Akira Gamou, Hiroshima (JP); Kazuhisa Kabeya, Kanagawa (JP)

(73) Assignee: JFE Steel Corporation, Tokyo (JP)

( * ) Notice: Subject to any disclaimer, the term of this patent is extended or adjusted under 35 U.S.C. 154(b) by 663 days.

(21) Appl. No.: 10/508,375

(22) PCT Filed: Sep. 9, 2003

(86) PCT No.: PCT/JP03/11478

§ 371 (c)(1),
(2), (4) Date: Nov. 2, 2004

(87) PCT Pub. No.: WO2004/024974

PCT Pub. Date: Mar. 25, 2004

(65) Prior Publication Data

US 2005/0115052 A1 Jun. 2, 2005

(30) Foreign Application Priority Data

Sep. 13, 2002 (JP) ..... 2002-267890
Sep. 13, 2002 (JP) ..... 2002-267891
Sep. 13, 2002 (JP) ..... 2002-267892

(51) Int. Cl.
*B23P 25/00* (2006.01)
*B21B 1/00* (2006.01)

(52) U.S. Cl. ..... 29/458; 29/527.2; 72/199; 72/366.2; 427/431; 427/434.3

(58) Field of Classification Search ..... 29/17.3, 29/446, 458, 527.2; 72/47, 199, 212, 250, 72/252.5, 365.2, 366.2; 700/148; 427/210, 427/431, 434.3, 434.4
See application file for complete search history.

(56) References Cited

U.S. PATENT DOCUMENTS 3,499,418 A * 3/1970 Mayhew ..... 118/665
3,808,033 A * 4/1974 Mayhew ..... 427/349

(Continued)

FOREIGN PATENT DOCUMENTS

JP 56-41365 A 4/1981

(Continued)

*Primary Examiner*—Jermie E Cozart
(74) *Attorney, Agent, or Firm*—Frishauf, Holtz, Goodman & Chick, P.C.

(57) ABSTRACT

The invention provides a method for producing a hot-dip plated metal strip comprising the steps of: annealing a metal strip; imparting plastic strain to the metal strip; drawing the metal strip into a molten metal bath for plating; drawing up the metal strip out of the molten metal bath without contacting the molten metal with a roll in the molten metal bath after turning around the metal strip upward with adhering the molten metal on the metal strip; and controlling the coating weight of the molten metal adhered on the metal strip with a wiper. According to the method of the invention, a hot-dip plated metal strip can be produced, in which buckling does not occur, lateral evenness of coating weight is excellent, and dross defects are few.

22 Claims, 14 Drawing Sheets

U.S. PATENT DOCUMENTS

| | | | | | |
|---|---|---|---|---|---|
| 4,078,103 | A | * | 3/1978 | Thornton et al. | 427/349 |
| 5,023,113 | A | * | 6/1991 | Boston et al. | 427/320 |
| 6,017,643 | A | * | 1/2000 | Kobayashi et al. | 428/653 |
| 6,093,452 | A | * | 7/2000 | Ishii et al. | 427/433 |
| 6,761,936 | B1 | * | 7/2004 | Reifferscheid et al. | 427/433 |
| 2003/0077397 | A1 | * | 4/2003 | Kabeya et al. | 427/431 |
| 2004/0052958 | A1 | * | 3/2004 | Dauchelle et al. | 427/431 |
| 2004/0052959 | A1 | * | 3/2004 | Dauchelle et al. | 427/431 |
| 2004/0241336 | A1 | * | 12/2004 | Brisberger | 427/431 |
| 2005/0048216 | A1 | * | 3/2005 | Brisberger et al. | 427/431 |

FOREIGN PATENT DOCUMENTS

| | | | | |
|---|---|---|---|---|
| JP | 4-272162 | A | | 9/1992 |
| JP | 5-156417 | A | | 6/1993 |
| JP | 05171385 | A | * | 7/1993 |
| JP | 7-94704 | B2 | | 10/1995 |
| JP | 7-268578 | A | | 10/1995 |
| JP | 11-100651 | A | | 10/1995 |
| JP | 10-130801 | A | | 5/1998 |
| JP | 2000-204460 | A | | 7/2000 |
| JP | 2000256884 | A | * | 9/2000 |
| JP | 2002-339051 | A | | 11/2002 |

* cited by examiner

METHOD FOR PRODUCING HOT-DIP COATED METAL BELT

This application is a U.S. National Phase Application under 35 USC 371 of International Application PCT/JP03/11478 filed Sep. 9, 2003.

FIELD OF THE INVENTION

The present invention relates to a method and apparatus for producing a hot-dip plated metal strip.

DESCRIPTION OF RELATED ARTS

Hot dipping is known as a method for plating a metal strip such as a steel strip continuously, in which the metal strip is immersed in molten metal such as zinc or aluminum and thus plated.

FIG. 1 shows a conventional continuous-type hot-dip plated metal strip production apparatus.

A metal strip 1 such as a steel strip after cold rolling is annealed in an annealing furnace 2 maintained at a non-oxidizing or reducing atmosphere; and subjected to surface cleaning and oxide film removal; and then continuously drawn into a molten metal bath 5 in a molten metal bath chamber 4 through a snout 3, and then turned around by a sink roll 6; and then drawn up from the molten metal bath 5 through support rolls 7; and then excessively adhered molten metal is wiped out by high pressure gas that is blown out from a gas wiping nozzle (wiper) 8 installed on the molten metal bath 5 in order to control plating weight in a predetermined amount, thereby a hot-dip plated metal strip is formed.

The support rolls 7, which are provided to correct a lateral warp of the metal strip 1 in the wiper 8 portion, and reduce scattering of an amount of the molten metal adhered in a lateral direction, are disposed in displaced positions along a forward direction of the metal strip 1 on both sides across the metal strip 1 like 7*a*, 7*b* shown in FIG. 1. A support roll 7*a* located in an upside is positioned on a path line, and a support roll 7*b* located in a downside is pressed against the metal strip 1, thereby the metal strip 1 is pressed in an appropriate amount and the lateral warp is corrected.

However, since the support rolls 7*a*, 7*b* are driven by a motor (not shown) installed laterally to a molten metal bath chamber 4 at a higher position than a surface of the molten metal bath 5 through a spindle (not shown), the support rolls 7*a*, 7*b* do not rotate uniformly even if the motor rotates uniformly, and the rotation speed is not correspondence with conveyance speed of the metal strip 1, therefore unevenness of the coating weight in a chatter mark pattern occurs in the metal strip 1.

To solve the problem, idling (no driving) of the support rolls 7*a*, 7*b* may be considered. However, in this case, pushing amount of the support roll 7*b* needs to be increased to secure the rotation of the support rolls 7*a*, 7*b*, therefore the lateral warp of the metal strip 1 can not be corrected appropriately in the wiper 8 portion, and the lateral scattering of the coating weight of the molten metal becomes large.

When galvanized steel strip is produced using the apparatus shown in FIG. 1, dross (so called, bottom dross) 16 that is an intermetallic compound of iron liquated from the steel strip 1 with a plating component is coiled up and floats in the molten metal bath 5. At that time, adhesion of the dross 16 on the steel strip 1 degrades surface quality of the steel strip 1. Moreover, adhesion of the dross 16 on the support roll 7 may cause scratch in the steel strip 1. Reduction of the conveyance speed of the steel strip 1 is effective for reducing the dross defects, however, which also reduces the production efficiency.

To solve the above problem due to the support roll or problem of the dross defects, the inventors proposed a method in JP-A-2002-339051, in which the support roll in the molten metal bath is removed, and the lateral warp of the metal strip is corrected in a noncontact manner by magnetic force immediately before or after the wiper, or a method in which an enclosed member is provided in the molten metal bath such that it encloses the metal strip, thereby occurrence of the dross defects is prevented.

However, since the support roll was removed, in a metal strip having yield point elongation to which the baking hardening property is imparted, a problem newly occurred, that is, a surface defect known as buckling was apt to occur.

The buckling may occur even in the conventional operation using the support roll in some operation conditions or steel types. Therefore, to improve the yield and realize the stable operation, a technique for producing a hot-dip plated metal strip in which the buckling hardly occurs without regard to presence of the support roll is also desired.

SUMMARY OF THE INVENTION

It is an object of the present invention aims to provide a method and an apparatus for producing a hot-dip plated metal strip in which the buckling does not occur, the lateral scattering of the coating weight of the molten metal is small or the dross defects are few, when the support roll is not present in the molten metal bath. In addition, the invention aims to provide a method and an apparatus for producing a hot-dip plated metal strip in which the buckling hardly occurs without regard to presence of the support roll in the molten metal bath.

The objects are achieved according to the following methods.

1) A method for producing the hot-dip plated metal strip comprising the steps of: annealing the metal strip; imparting plastic strain to the metal strip; drawing the metal strip into a molten metal bath for plating; drawing sup the metal strip out of the molten metal bath without contacting the metal strip with a roll in the molten metal bath after turning around the metal strip upward with adhering the molten metal on the metal strip; and controlling the coating weight of the molten metal adhered on the metal strip using a wiper.

2) A method for producing the hot-dip plated metal strip comprising the steps of: annealing the metal strip; imparting surface plastic strain to the metal strip using at least one roll by bending after heating the metal strip to the maximum temperature in the annealing and before drawing the metal strip into the molten metal bath for plating; drawing the metal strip into the molten metal bath for plating and adhering the molten metal on the metal strip; and drawing up the metal strip out of the molten metal bath after turning around the metal strip using a sink roll, wherein the surface plastic strain of the metal strip is imparted such that the strain remained on a surface of the metal strip is 0.1% or more when the metal strip arrives at the sink roll (hereinafter, referred to as surface residual plastic strain).

3) A method for producing the hot-dip plated metal strip comprising the steps of: annealing the metal strip; imparting the surface plastic strain to the metal strip using at least one roll by bending after heating the metal strip to the maximum temperature in the annealing and before drawing the metal strip into the molten metal bath for plating; drawing the metal strip into the molten metal bath for plating and adhering the molten metal on the metal strip; and drawing up the metal strip out of the molten metal bath after turning around the metal strip using the sink roll, wherein a roll located at the most downstream side among the rolls for imparting the surface plastic strain to the metal strip by bending is disposed at a side of an opposite surface to a surface of the metal strip that contacts with the sink roll in the molten metal bath.

These methods are realized according to the following apparatus respectively.

1) An apparatus for producing the hot-dip plated metal strip comprising an annealing furnace for annealing the metal strip; strain imparting means for imparting the plastic strain to the metal strip after the annealing; a molten metal bath for adhering the molten metal for plating on the metal strip to which the plastic strain has been imparted; and a wiper for controlling the coating weight of the molten metal adhered on the metal strip, wherein only a turnaround device for turning around the metal strip is provided in the molten metal bath.

2) An apparatus for producing the hot-dip plated metal strip comprising the annealing furnace for annealing the metal strip; at least one roll for imparting the surface plastic strain to the metal strip by the bending, which is provided at apposition after the metal strip is heated to the maximum temperature in the annealing and before the metal strip is adhered with the molten metal for plating; and a molten metal bath for adhering the molten metal for plating on the metal strip, wherein the metal strip is turned around by the sink roll in the molten metal bath, and the surface plastic strain of the metal strip is imparted to the metal strip such that the surface residual plastic strain remained on the surface of the metal strip is 0.1% or more at a point when the metal strip arrives at the sink roll.

3) An apparatus for producing the hot-dip plated metal strip comprising the annealing furnace for annealing the metal strip; at least one roll for imparting the surface plastic strain to the metal strip by the bending, which is provided at the position after the metal strip is heated to the maximum temperature in the annealing and before the metal strip is adhered with the molten metal for plating; and the molten metal bath for adhering the molten metal for plating on the metal strip, wherein the metal strip is turned around by the sink roll in the molten metal bath, and a roll located at the most downstream side among the rolls for imparting the surface plastic strain to the metal strip by the bending is disposed at a side of an opposite surface to the surface of the metal strip that contacts with the sink roll in the molten metal bath.

EMBODIMENTS FOR CARRYING OUT THE PRESENT INVENTION

Figure 2:
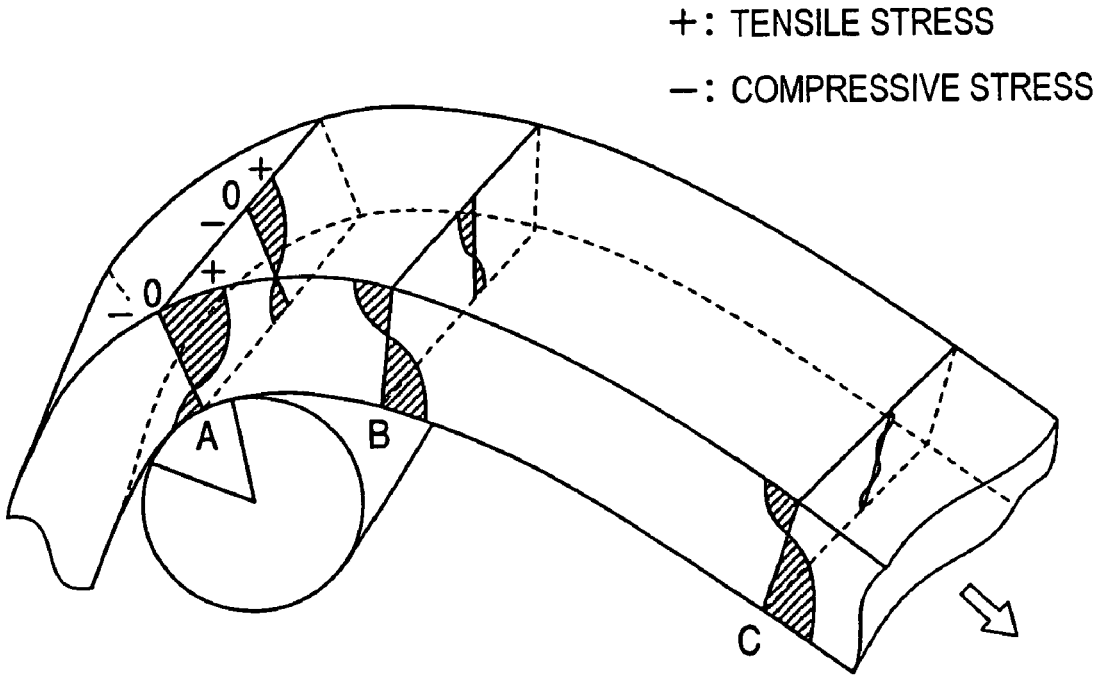
FIG. 2 is a view illustrating occurrence of lateral warp of the metal strip.

As shown in FIG. 2, it is considered that the occurrence of the lateral warp of the metal strip is mainly caused by that the metal strip is bent and bent back by the sink roll. In a position A where the metal strip contactually winds around the sink roll, the metal strip receives compressive stress at a side contacting with the sink roll due to plane strain deformation, and tensile stress at an opposite side thereto, and stress distribution helping the lateral warp is formed. Also in a position B, which is close to the sink roll and has a comparatively large radius of curvature, the metal strip is kept in a substantially plane strain condition, and receives a stress distribution oppositely to the position A, that is, tensile stress at the side contacting with the sink roll and compressive stress at the opposite side thereto. In a position C where the radius of curvature is almost zero, there is no restriction on the in-plane deformation, a shape in which the deformation given at the position A is easily maintained, or an upward convex shape laterally to the metal strip is considered to be formed. When warp occurs laterally to the metal strip in this way, a space between the metal strip and the wiper is not constant laterally, therefore lateral scattering of the coating weight of the molten metal occurs. When warp occurs in the metal strip, the space between the two must be set wide in order to avoid contact of the metal strip with the wiper. Therefore, gas pressure of the wiper needs to be increased to secure a desired wiping ability of the molten metal, and splash defects tend to occur, which is caused by adhesion of the molten metal on the metal strip that is vigorously scattered at that time.

Figure 3:
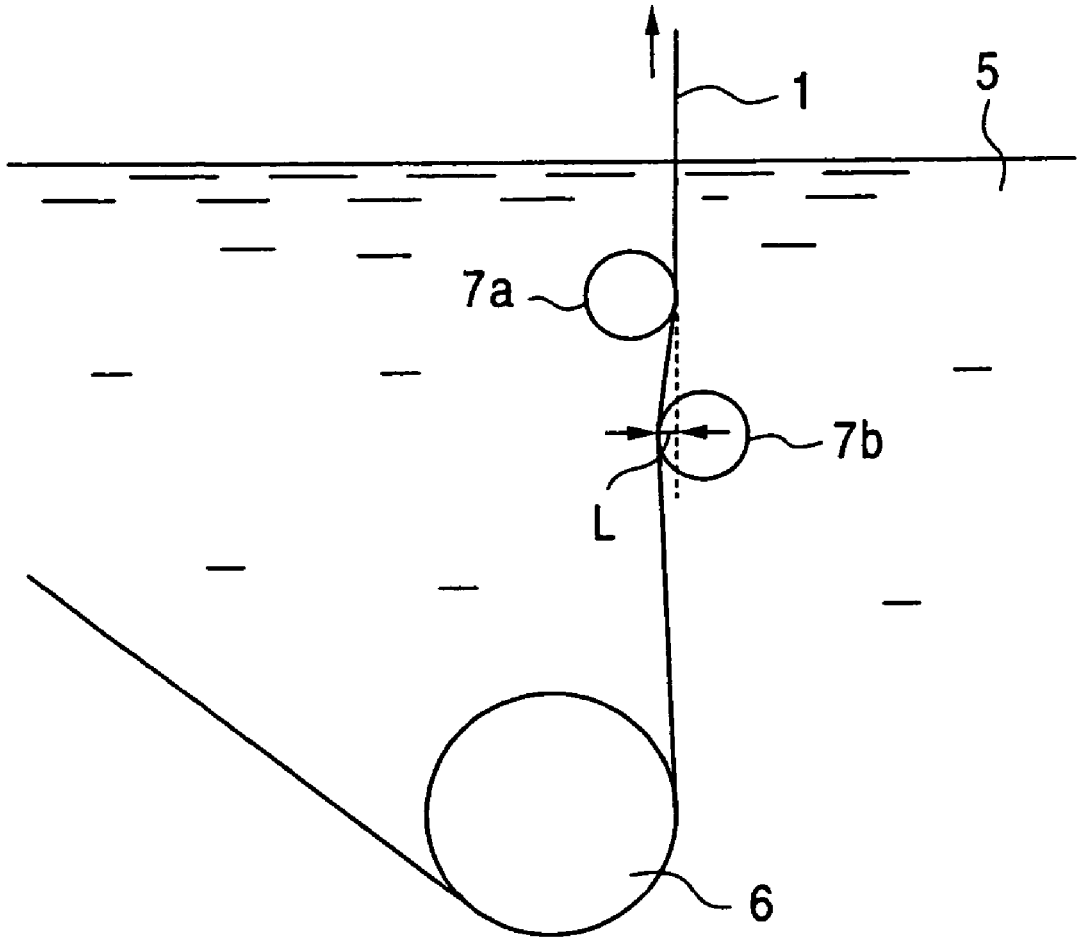
FIG. 3 is a view illustrating correction of the warp by a support roll.

The support roll in the molten metal bath has a function of correcting such lateral warp of the metal strip. As shown in FIG. 3, the metal strip 1 that is turned around upward by the sink roll 6 is supported by the support roll 7*a* located on a path line, and pushed against the path line only by a predetermined distance L by the support roll 7*b* disposed only a predetermined distance below the support roll 7*a* and bent reversely, thereby the warp is corrected.

However, when the support roll is present in the molten metal bath, in addition to the problems of the uneven coating weight in the chatter mark pattern or scratch as described above, there is a problem that shutdown of equipment is necessary for regular maintenance or exchange of the support roll, resulting in reduction of the operation efficiency.

Even when the support roll is used, if the warp of the metal strip can be reduced immediately after it has been turned around by the sink roll, pushing distance of the support roll can be set small, which is advantageous for preventing defects such as push flaw.

Thus, first, the inventors investigated what problem is occurred by removing the support roll from the molten metal bath.

First, since it is said that removal of the support roll increases the defects in the metal strip, because the support roll has a function of making adhesion of a foreign such as dross in the molten metal bath to be difficult, in addition to the function of correcting the warp of the metal strip; the following experiments were conducted for reality check. That is, rolls in imitation of the sink roll and the support roll and an endless belt in imitation of the metal strip were disposed in a container filled with water instead of the molten metal, and the roll diameter and roll rotational frequency were set such that Reynolds number or Floude number was equal to that around the roll in the actual molten metal bath, and behavior in the molten metal bath was hydrodynamically simulated, and aluminum powder was added as a tracer and flow of the powder was observed.

As a result, the roll in imitation of the support roll did not show the action of removing the aluminum powder adhered on the belt, and only showed an action of pressing the aluminum powder against the belt. Therefore, it is considered that the support roll in the molten metal bath has not the function of making the adhesion of the foreign to the metal strip to be difficult as described above, therefore removal of the support roll will not increase the defects. Actually, when the support roll was removed from the continuous-type hot-dip plated metal strip production apparatus shown in FIG. 1 and a galvanized steel strip was produced, increase of the dross defects was not confirmed. Accordingly, the support roll can be removed, if the function of correcting the lateral warp of the metal strip may be achieved in an alternative method.

To this end, it is desirable that the warp can be corrected in a noncontact manner, and the inventors confirmed that the warp of the galvanized steel strip was able to be corrected in the noncontact manner using magnetic force by an electromagnet.

However, by removing the support roll, if a galvanized steel strip having yield point elongation is produced, the steel strip being imparted with a baking hardening property, sometimes a strain pattern known as "buckling" is generated on a surface of the steel strip when the steel strip passes through the equipment mainly located at a downstream side of the molten zinc bath chamber. Although the defect can be made less noticeable by skin-pass, the defect sometimes appears again when the steel strip is pressed into final products, therefore it largely reduces product yield in some usage.

In some operation conditions or steel types, the buckling may occur even if the support roll is used.

The inventors had investigated causes of such buckling and a measure for preventing the buckling, consequently obtained the following findings.

1) When the steel strip passes through the continuous-type hot-dipping steel strip production apparatus, the band receives bending stress by rolls in various temperature ranges, and when the stress exceeds the yield stress of the steel strip, the bent portion of the steel strip locally yields, resulting in the buckling.

2) The buckling occurs in a temperature range lower than a certain temperature T1 (referred to as threshold temperature), and does not occur at the threshold temperature T1 or higher. It is considered that since the threshold temperature T1 corresponds to the temperature at which the yield point elongation disappears when tensile tests are conducted at various different temperatures, the yield point elongation is lost and thus local strain concentration is avoided, thereby occurrence of the buckling is suppressed.

3) Generally, at the room temperature, it is known that when the steel strip is previously imparted with strain, the buckling hardly occurs even if the band is subsequently machined. Also, similar effects are obtained when the steel strip is previously imparted with the strain at the above threshold temperature T1 or higher. That is, the buckling does not occur even if the band is subsequently machined at the threshold temperature T1 or lower. However, when the strain is imparted at a temperature of more than 650° C., the effects are reduced.

4) When the steel strip is previously imparted with the strain at the threshold temperature T1 or higher, the warp of the steel strip can be corrected, and sometimes, it may be an alternative of the function of correcting the warp of the steel strip using the magnetic force by the electromagnet.

5) Since the buckling occurs in a step at a downstream side of the molten zinc bath in the continuous-type hot-dipping steel strip production apparatus, temperature of the steel strip becomes the threshold temperature T1 at a position where the temperature of the molten zinc bath is 450 to 480° C. or higher, or a position between an annealing furnace and the molten zinc bath.

Therefore, when the temperature of the metal strip is 450 to 650° C. when the metal strip is a steel strip, if the metal strip is imparted with plastic strain before the metal strip is drawn into the molten metal bath after the annealing, the buckling can be prevented. That is, according to a method for producing the hot-dip plated metal strip, having a step of annealing the metal strip; a step of imparting the plastic strain to the metal strip; a step of drawing the metal strip into the molten metal bath for plating; a step of drawing up the metal strip out of the molten metal bath without contacting the metal strip with the roll in the molten metal bath after turning around the metal strip upward with adhering the molten metal on the metal strip; and a step of controlling the coating weight of the molten metal adhered on the metal strip using the wiper, a hot-dip plated metal strip can be produced, in which the buckling does not occur and the lateral warp of the metal strip in the wiper portion can be prevented.

Furthermore, if the support roll is designed to be installed in the molten metal bath and pushed against the metal strip, the buckling can be further reduced. In addition, while described later, in some strain impartation conditions, the previously imparted plastic strain may cancel the warp caused by the sink roll.

If the shape of the metal strip is corrected in the noncontact manner by the magnetic force immediately before or after the wiper, the coating weight can be made more uniform.

The stress causing the buckling is at maximum near the surface of the metal strip, when the stress is a bending stress given by the roll. Therefore, it is effective that the plastic strain imparted for preventing the buckling is imparted by bending, in which the strain is efficiently imparted to the vicinity of the surface of the metal strip. When the metal strip is the steel strip, the plastic strain is preferably imparted before the steel strip is drawn into the molten metal bath after annealing and when temperature of the steel strip is 450 to 650° C., as described above. Although the bending can be performed easily using the roll, the plastic strain amount to be imparted to the metal strip for preventing the buckling is preferably more than 0.1%, for example, in the surface plastic strain, and when the amount is more than 1.5%, the effect is saturated, in addition, material of the steel strip is sometimes deteriorated.

While described later in detail, surface residual plastic strain, which is remained on the surface of the metal strip at a point when the metal strip arrives at the sink roll in the molten metal bath, is more important for preventing the buckling and preventing the warp at the sink roll than the above surface plastic strain imparted to the metal strip, and preferably the surface residual plastic strain is made to be 0.1% or more. As the plastic strain is imparted at higher temperature, the strain is lost more easily before the metal strip arrives at the sink roll, and the surface residual plastic strain tends to be less than 0.1%, therefore the metal strip needs to be conveyed to the sink roll more speedily in a shorter time.

The plastic strain need not be imparted in one time, may be imparted in several times. When the strain is imparted in several times, the amount of the plastic strain is sum of the amount of strain imparted for each time. The imparted strain may be compressed strain or tensile strain, and the amount of the plastic strain when the two are present together is the total of them. It is assumed that this is because buckling prevention mechanism is due to transition that is independent of compression and tension.

To prevent the warp at the sink roll by giving the plastic strain by the bending using plural rolls, it is preferable that the roll located at the most downstream side, which can give the surface residual plastic strain in a certain level or more, is disposed such that the roll contacts with the opposite surface to the surface at which the sink roll contacts with the metal strip.

When the bending is performed using the roll, a roll having an outer diameter of 800 mm or less is preferably used. If the number of rolls is made to be 6 or more, and strain is imparted dividedly, the strain impartation effect is saturated, therefore number of rolls is preferably 5 or less.

Although JP-B-7-94704, JP-A-10-130801, and JP-2000-204460 describe that the steel strip is bent using the roll in the hot-dipping steel strip production apparatus, each of them assumes that the support roll is present in the molten zinc bath, and the problem and components are different from those of the invention. That is, the method of JP-B-7-94704 is a method in which the steel strip is bent using a roll having a diameter of 50 to 500 mm and then annealed to make the crystal grain size uniform; solid-liquid reaction in the molten zinc bath and the subsequent Fe—Zn alloying reaction are progressed uniformly; and a defect of an uneven surface produced in the alloying step is prevented, and bending is performed before the annealing. The method of JP-A-10-130801 is a method in which the bending and bending back are performed in a bending radius of 300 mm or less; diffusion reaction an interface between the steel sheet and plating is unified by imparting residual strain to a surface of the steel strip; and uneven alloying or uneven brightness due to uneven distribution of added elements such as Si, P, and Mn is prevented, in addition, it does not describe the buckling. Also, it does not describe that the above surface residual plastic strain involves the prevention of the buckling and the warp at the sink roll. The method according to JP-2000-204460 is a method in which the steel strip is pushed by the roll using two points on the path line as supporting points in a conveyance room at a non-oxidizing atmosphere; thereby the warp of the steel sheet is corrected, however, it is hard to impart sufficient tension stably to the steel strip because the sink roll is not present, and the plastic strain can not be imparted stably to the surface of the steel strip.

Next, an embodiment where the metal strip is the steel strip, and the molten metal is zinc is described in detail.

Figure 4:
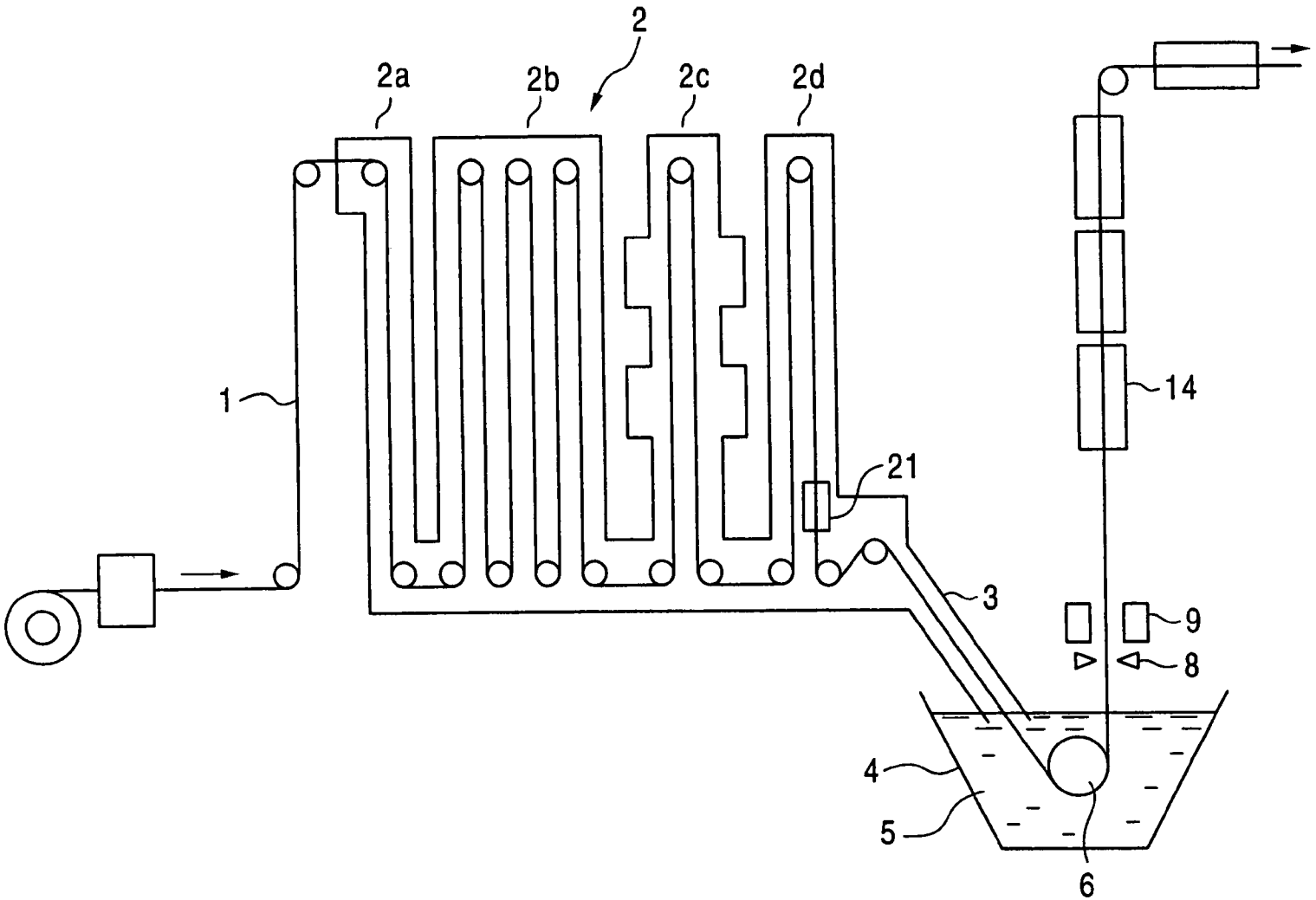
FIG. 4 is a view showing an example of the hot-dip plated metal strip production apparatus of the present invention.

FIG. 4 shows an example of a hot-dipping steel strip production apparatus of the invention. This example is a case that the support roll is removed, and the warp at the sink roll is corrected by the electromagnet.

Figure 1:
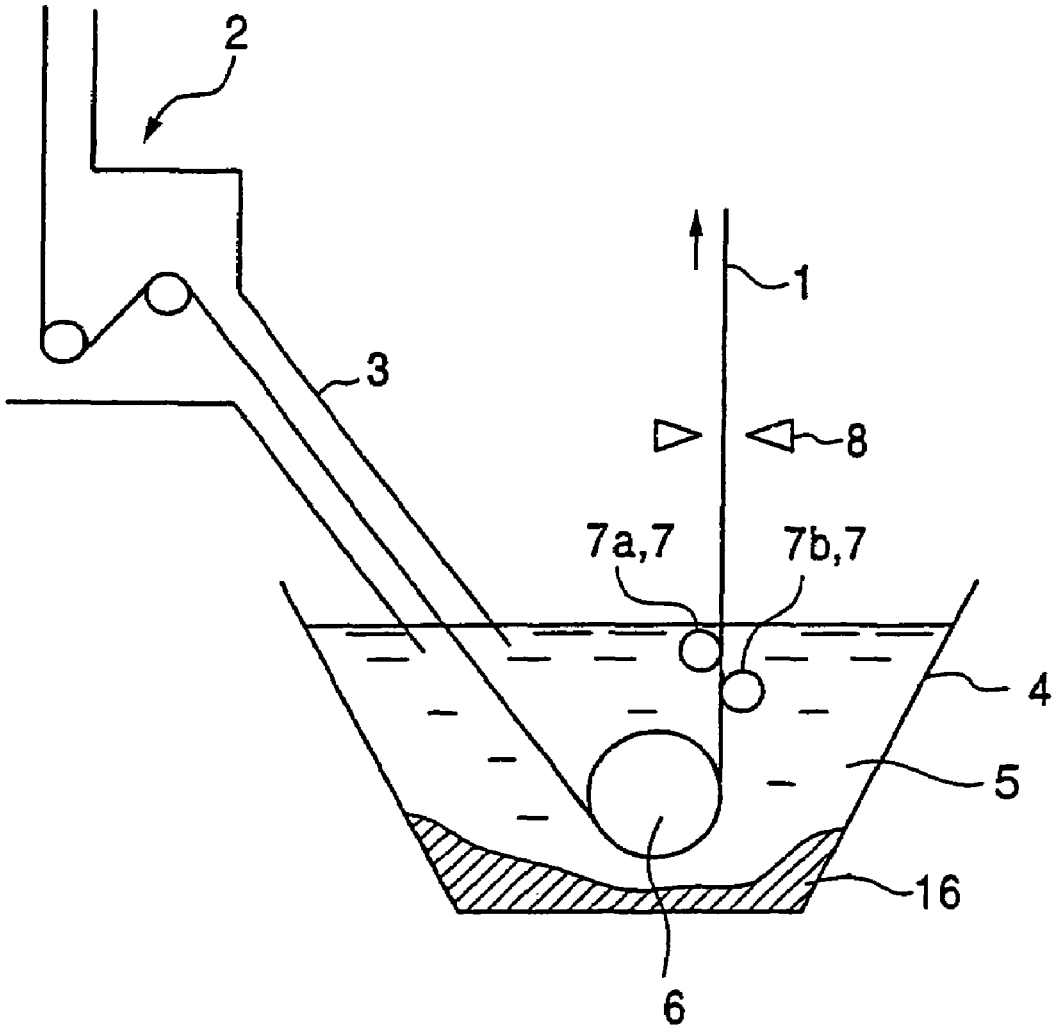
FIG. 1 PRIOR ART
FIG. 1 is a view showing a conventional continuous-type hot-dip plated metal strip production apparatus.

In this apparatus, the support roll 7 in the molten zinc bath 5 in the conventional production apparatus shown in FIG. 1 is removed, and strain imparting device 21 is installed in a controlling cooled reactor 2*d* in the annealing furnace 2 and shape correcting means 9 for correcting the shape of the steel strip 1 using the electromagnet in the noncontact manner is installed immediately after the wiper 8. Although the strain imparting device 21 may be installed in the snout 3 portion at 450 to 650° C., when the device is installed in the controlling cooled reactor 2*d* in the annealing furnace 2, the temperature of the steel strip 1 is more easily controlled to 450 to 650° C. More preferably, the steel strip 1 is imparted with the strain at 500 to 550° C. This is because when the temperature of the steel strip 1 is more than 550° C., the imparted plastic strain is sometimes lost and thus the effect of imparting the strain is reduced, and when the temperature is lower than 500° C., the temperature of the steel strip 1 immersed in the molten zinc bath 5 becomes lower, that is, thermally disadvantageous. In the steel strip 1 having the yield point elongation, in which the buckling is actually problem, since the above threshold temperature T1 is about 450° C., from the consideration of variation of operation conditions, the strain is preferably imparted at 500° C. or more.

Although the strain may imparted in the molten zinc bath 5 or imparted after the steel strip being drawn up from the molten zinc bath 5 only for preventing the buckling, since problems such as the uneven coating weight of the molten zinc in the chatter mark pattern, push flaw, and plating separation occur, the strain impartation needs to be performed at an upstream side of the molten zinc bath 5.

Figure 5:
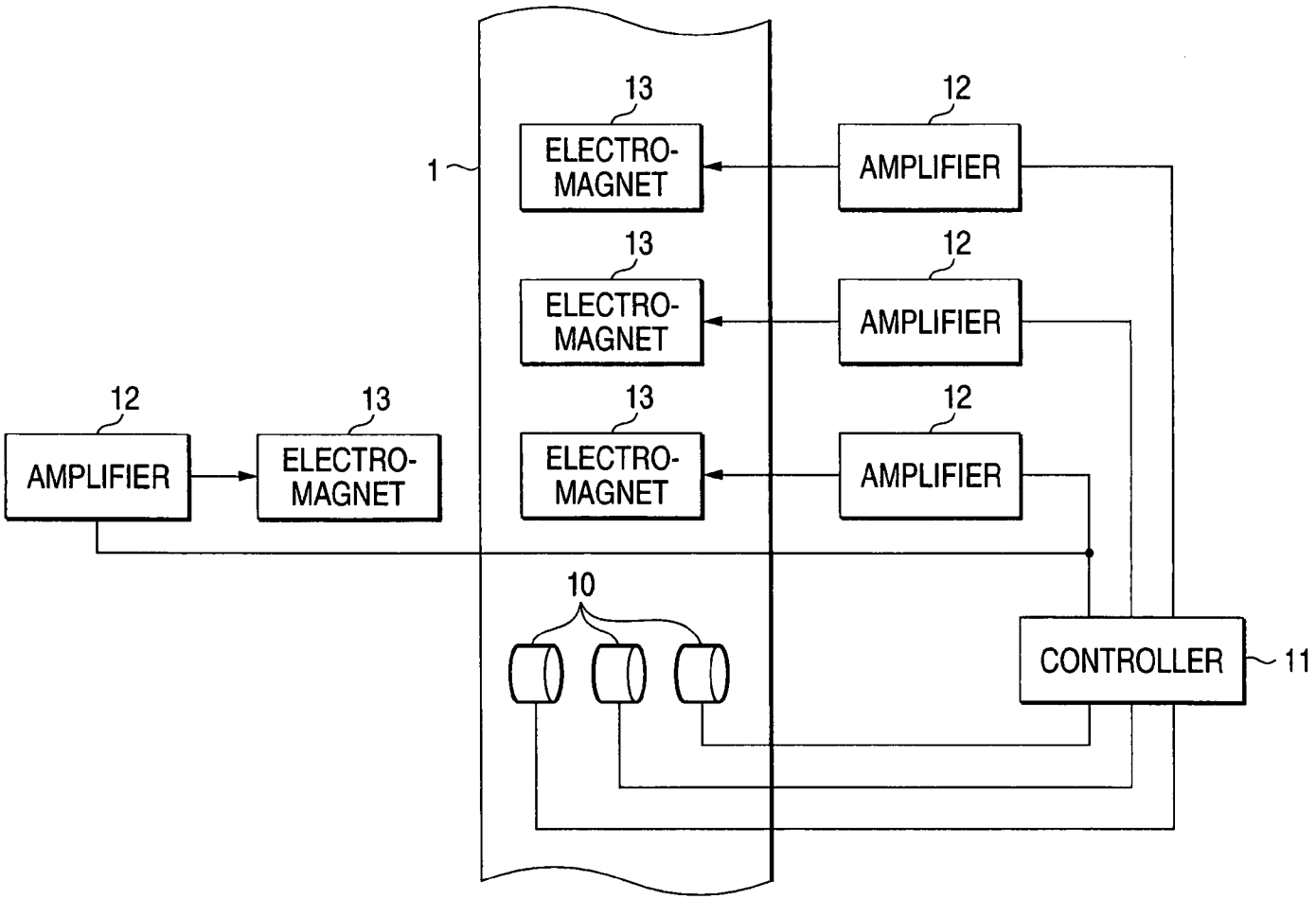
FIG. 5 is a view showing an example of shape correcting means for correcting a shape of the metal strip in a non-contact manner by magnetic force.

FIG. 5 shows an example of the shape correcting means.

The shape correcting means comprises a position sensors 10 that measure distances to the surface of the steel strip 1 moving upward in the figure; a controller 11 that receives a signal from the position sensors 10 and outputs a control signal; amplifiers 12 that amplify the control signal; and electromagnets 13 that exert sucking force on the steel strip 1 according to the amplified control signal and transforms the steel strip 1. The electromagnets 13 are installed plurally in a lateral direction of the steel strip 1, and disposed on both sides of the steel strip 1 in pairs. Since the electromagnets 13 exert the sucking force one-directionally on the steel strip 1, by disposing the electromagnets on the both sides of the steel strip 1 in pairs, a sucking direction of the steel strip 1 can be selected and the warp of the steel strip 1 can be corrected. Typically, in most cases, the lateral warp of the steel strip 1 has a C-section as shown in FIG. 2, therefore the electromagnets 13 are disposed at three points in the lateral direction of the steel strip 1 (both edges and center). Since interference among respective position sensors 10 and among respective electromagnets 13 at the three points is not so large, each of them can be constituted using an independent control system.

If the sucking force of the electromagnets 13 disposed on the both sides of the steel strip 1 in pairs is controlled by the controller 11 according to the signal from the position sensors 10 that measure the distance to the surface of the steel strip 1, the warp of the steel strip 1 drawn up from the molten zinc bath 5 can be corrected.

While the shape correcting means 9, which is disposed immediately after the wiper 8, performs better control as it is closer to the wiper 8, when an alloying furnace, a touch roll, and a spangle adjustor are installed, it may be installed before the spangle adjustor. When the means 9 is installed immediately before the wiper 8, while it performs better control as it is closer to the wiper 8, it, may be installed between the molten zinc bath 5 and the wiper 8 in an actual line.

The strain imparting device 21 is installed at a downstream side of the point where the steel strip 1 arrives at the maximum temperature. Since the steel strip 1 is heated to the maximum temperature of 650 to 900° C. in a soaking pit 2*b* of the annealing furnace 2, if the strain imparting device 21 is installed at an upstream side of the point where the steel strip 1 arrives at the maximum temperature, the effect of imparting the strain is lost, and the buckling can not be prevented.

Although it is preferable in the strain imparting device 21 that the plastic strain is imparted such that the surface residual plastic strain is 0.1% or more as described above, to this end, the strain needs to be imparted more than 0.1%, more preferably not less than 0.3% and not more than 1.5% in the amount of the surface plastic strain.

As described above, from a viewpoint of imparting the plastic strain to the surface, bending using the roll is effective. When the bending is performed using the roll, it is preferable that an outer diameter of the roll is selected such that the radius of curvature of the steel strip 1 imparted by at least one roll is 400 mm or less, and the steel strip 1 is bent with the pushing amount of the roll being controlled. To bend the steel strip 1 at the radius of curvature of 400 mm or less, at least one roll having an outer diameter of 800 mm or less needs to be used. For example, the bending can be achieved in a method of controlling the pushing amount such that the steel strip 1 winds around the roll having an outer diameter of 800 mm sufficiently, or a method of controlling the pushing amount using a roll having an outer diameter of 400 mm. However, the pushing amount of the roll is different depending on material or thickness of the steel strip 1. To increase the amount of the imparted surface plastic strain, the pushing amount of the roll can be increased, or a roll having a small outer diameter can be used. The outer diameter of the roll is preferably 400 mm or less.

A roll having an outer diameter of more than 800 mm such as a hearth roll, which is generally installed in the vertical type annealing furnace 2, is not used as the roll for imparting the plastic strain.

When the same amount of surface plastic strain is imparted, the effect of imparting the strain is higher in the case that the number of the rolls is one. The strain may be imparted dividedly in a plurality of rolls, the effect is saturated even in 6 or more rolls, which is disadvantageous in a point of facility cost or facility maintenance, therefore the number of rolls is preferably 1 to 5. When the number of the rolls is one, the amount of impartable surface plastic strain can not be significantly increased, therefore more preferably, the actual number of rolls is made to be 2 to 3. When two or more rolls are used, each of rolls may have a different outer diameter.

Figure 6:
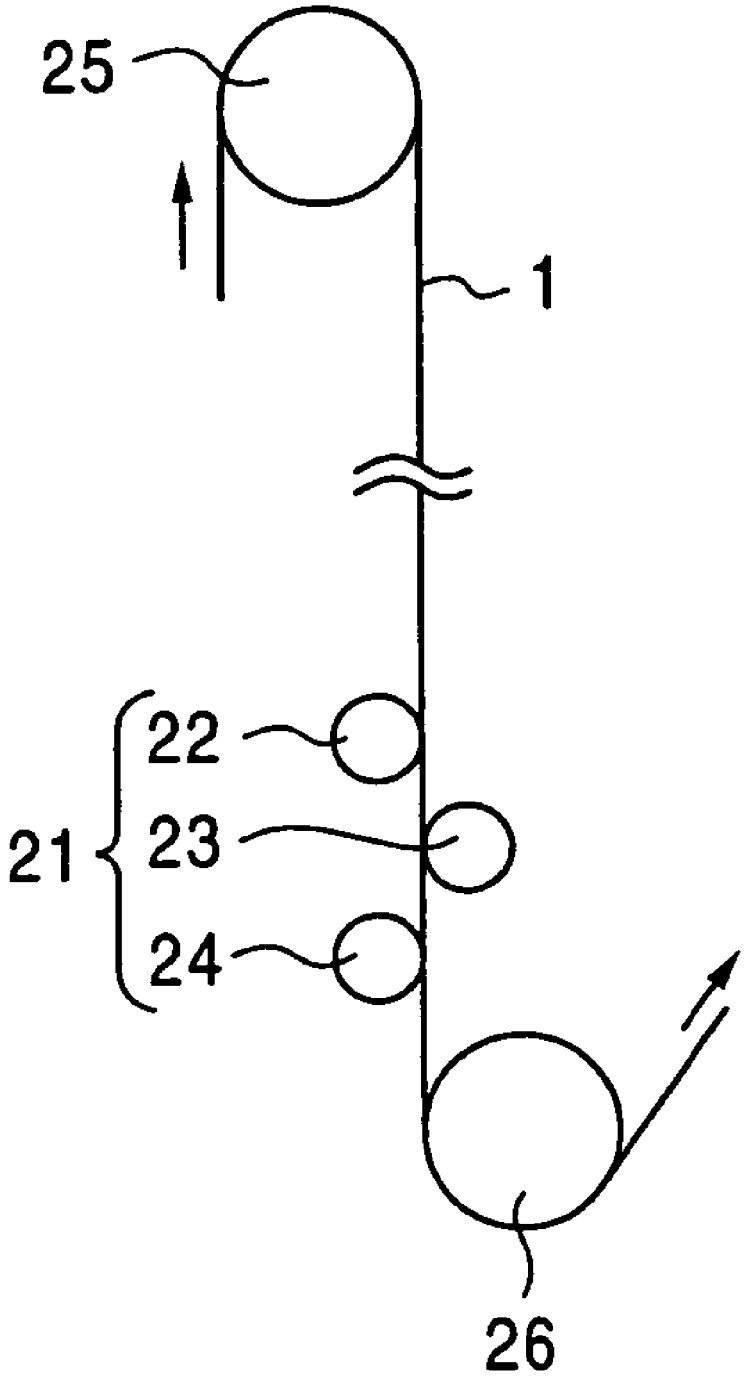
FIG. 6 is a view showing an example of a strain imparting device.

FIG. 6 shows an example of the strain imparting device.

The strain imparting device 21, which is provided at an intermediate position between hearth rolls 25 and 26 in the controlling cooled reactor 2*d* comprises three rolls 22, 23, and 24. The three rolls are disposed alternatively on both sides of the steel strip 1, and each of them is freely movable independently in a substantially perpendicular direction to the path line. At least one of the three rolls 22, 23, and 24 is pushed in a direction substantially perpendicular to the path line, thereby the steel strip 1 is imparted with the surface plastic strain. The amount of the imparted surface plastic strain is determined by the radius of curvature of the steel strip 1 that has been bent, and the curvature is determined by a space between adjacent rolls along the path line, the outer diameter, and the pushing amount of the roll. It is further simple that relation between material or thickness of the steel strip 1, operation parameters such as temperature, the space between the adjacent rolls, the outer diameter of roll, or pushing amount of the roll and the amount of surface plastic strain is previously obtained and a correlation table is prepared, and the pushing amount of the roll is set according to the operation parameter values based on the correlation table.

Although three rolls are disposed in the device shown in FIG. 6, the number of rolls is not limited to three and may be varied within a range from 1 to 5. When the number of rolls is one, from a viewpoint of improving the effect of imparting the bending strain, the roll is preferably disposed near the hearth roll 26.

The inventors found that when the steel strip 1 is imparted with the strain using the strain imparting device 21 shown in FIG. 6, if the disposing conditions and the pushing conditions of the rolls 22, 23, and 24 were varied, the amount of lateral warp of the steel strip 1 in the wiper 8 portion at the downstream side was varied. Moreover, the inventors found that how the pushing was reflected in the downstream was important for suppressing the buckling.

FIGS. 7A to 7D show examples of strain impartation by the three rolls in FIG. 6.

Figure 7A:
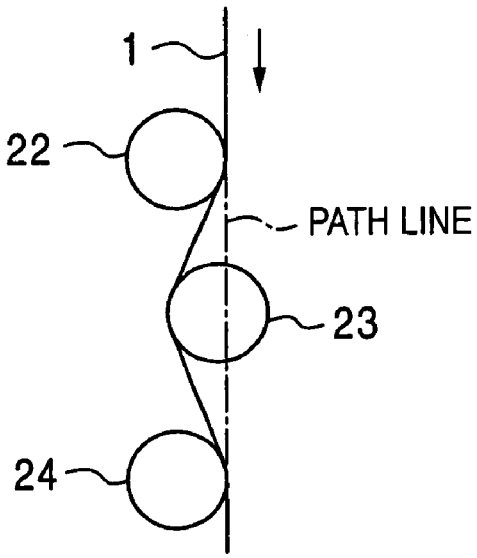
FIG. 7A to 7D are views showing examples of strain impartation using the strain imparting device of FIG. 6.

In FIG. 7A, the rolls 22 and 24 are disposed substantially on the path line, and the roll 23 is pushed in a direction substantially perpendicular to the path line, thereby surface plastic strain is imparted to the steel strip 1.

Figure 7B:
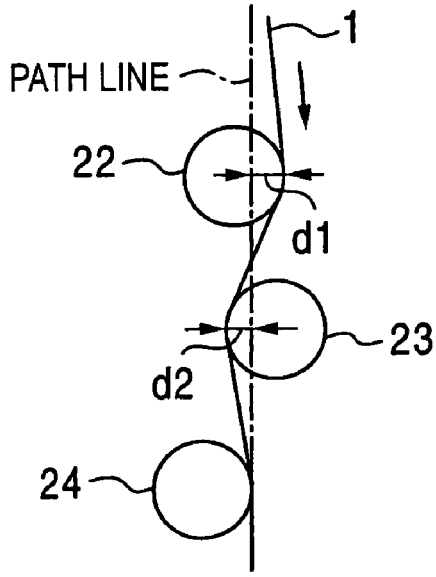

In FIG. 7B, the roll 24 is disposed substantially on the path line, and the rolls 22 and 23 are pushed oppositely in a direction substantially perpendicular to the path line, thereby the plastic strain is imparted to the surface of the steel strip 1.

Figure 7C:
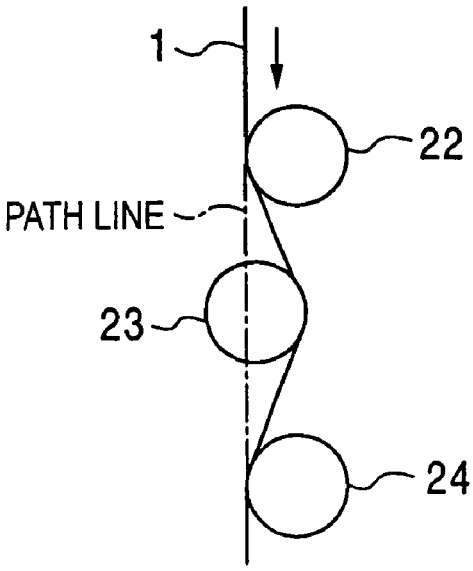
Figure 7D:
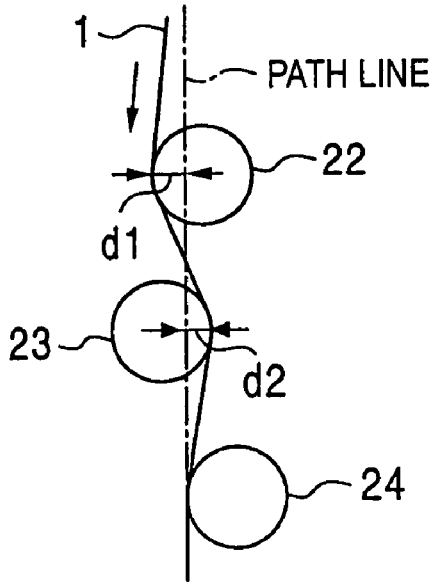

In FIGS. 7C and 7D, the plastic strain is imparted to the surface of the steel strip 1 in a reverse arrangement of the three rolls 22, 23, and 24 against the surface of the steel strip 1.

In FIGS. 7A and 7B, since the roll 24 located at the most downstream side is disposed at a side of an opposite surface to the surface of the steel strip 1 that contacts with the sink roll, the roll 24 cancels the lateral warp of the steel strip 1 occurred at the sink roll, therefore those are examples of more advantageous strain impartation for correcting the warp.

On the other hand, in FIGS. 7C and 7D, since the roll 24 located at the most downstream side is disposed at a side of the same surface as the surface of the steel strip 1 that contacts with the sink roll, the roll 24 is apt to increase the lateral warp of the steel strip 1 occurred at the sink roll. Particularly, the tendency appears strongly in using the support roll, and sometimes the warp at the support roll is too large, and thus correction of warp is difficult.

It is more advantageous that the strain is imparted dividedly by the rolls 22 and 23 as shown in FIG. 7B than that the strain is imparted in one time by the roll 23 as shown in FIG. 7A.

Figure 8:
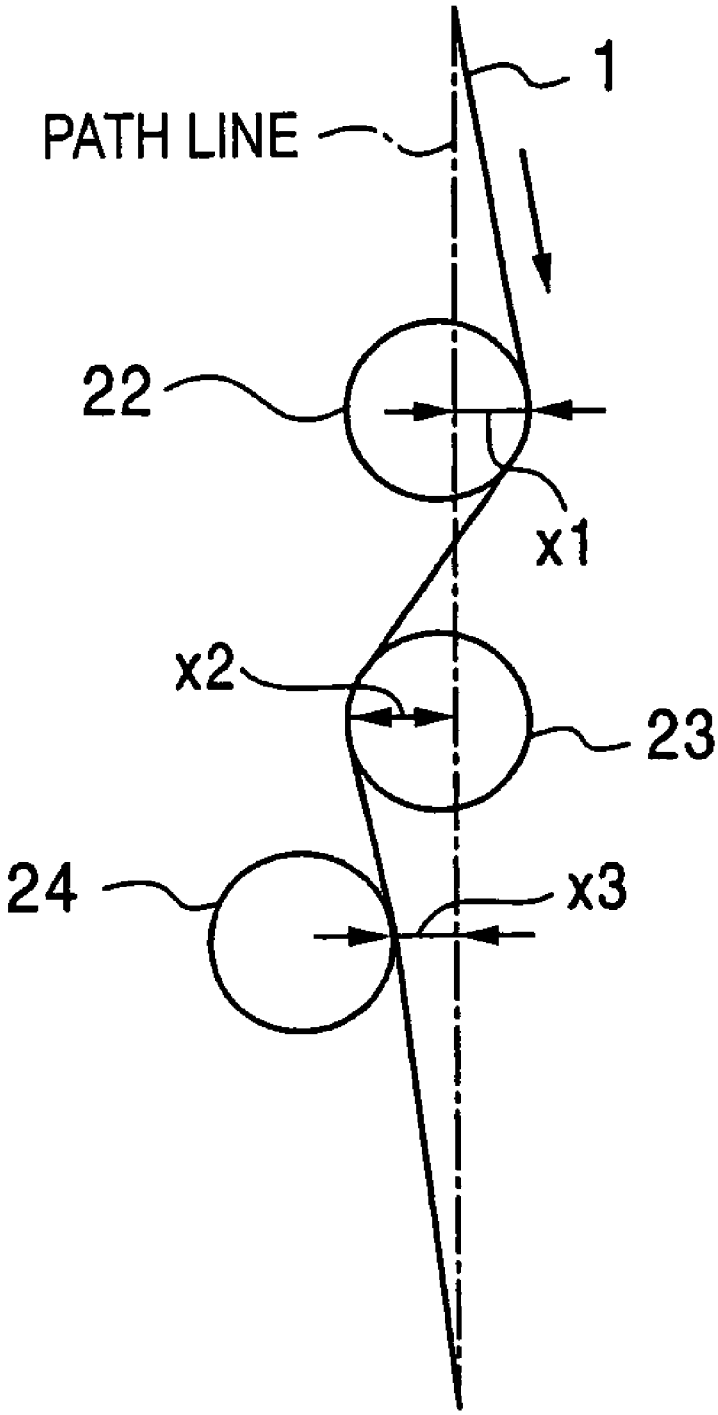
FIG. 8 is a view showing another example of strain impartation in the strain imparting device of FIG. 6.

Since the strain imparted by the roll 24 at the most downstream side is determined according to a relative positional relationship between the roll 24 and the rolls 22, 23 at an upstream side, when the pushing amount of the rolls 22, 23 is large, the roll 23 is sometimes displaced from the path line. For example, as shown in FIG. 8, when the pushing amounts of the rolls 22, 23, and 24 from the path line are x1, x2, and x3 respectively (pushing to the right in the figure from the path line is shown as "+", and pushing to the left in the figure as "−"), and the pushing amount of the roll 22 |x1| is made to be small, and the pushing amount of the roll 23 |x2| is large, since the strain imparted by the roll 24 is determined by the relative position of the roll 24 to the roll 23, |x2-x3|, it is preferable that the roll 24 is pushed to the left in the figure from the path line.

Here, "roll is on the path line" is that the roll surface locates at a position where the roll surface contacts with the path line.

As described above, the surface residual plastic strain, which is remained on the surface of the steel strip 1 at the point when the steel strip arrives at the sink roll in the molten zinc bath, is more important for preventing, the buckling and the warp by the sink roll than the surface plastic strain, which is imparted to the steel strip by the strain imparting device such as the device in FIG. 6. This is because it is considered that the plastic strain is scarcely lost at a downstream side of the molten zinc bath at about 450° C. Actually, it has been confirmed from the following rate theoretical investigation that the plastic strain is scarcely lost, even if alloying treatment for about 3 sec at 550° C. is performed at the downstream side of the molten zinc bath. Accordingly, if the amount of residual strain is controlled at the sink roll after which the plastic strain is not lost, the buckling or warp can be prevented more effectively.

Since the surface residual plastic strain A is in proportion to the amount of dislocation near to the surface of the steel strip, the strain A concerns with the first imparted surface plastic strain A0, average temperature T of the steel strip from the point of imparting the strain to the sink roll, and travel time t of the steel strip moving from the strain imparting device to the sink roll, and expressed in the following equation (1):

$$A=A0\times\exp\{-t\times b\times\exp(a\times T)\} \quad (1),$$

where a and b are coefficients determined from a steel type, and the value of a is about 0.032 and b is about $1\times10^{-10}$.

Specifically, the values of a and b are obtained by imparting a fixed amount of strain to a certain type of steel, and measuring the amount of strain after heat treatment for a fixed time at a certain temperature. Mean while, a concerns with the activation energy for diffusion of the strain, and b concerns with the diffusion coefficient.

Whether the strain is lost is similar to the problem of diffusion, therefore the lost strain is expressed in a function of exp (a×T), and the above equation (1) is obtained from boundary conditions that A is A0 at t=0 sec and A is 0 at t=∞.

Table 1 shows a calculation example of the surface residual plastic strain A when A0 is fixed to 0.1, and t and T are varied.

It was cleared from such calculation results that when surface plastic strain of 1.5% or less is imparted to a steel strip at 650° C. or more, the steel strip is preferably moved to the sink roll within 10 sec; when surface plastic strain of not less than 0.35% and not more than 1.5% is imparted to a steel strip at not less than 600° C. and less than 650° C., the steel strip is preferably moved to the sink roll within 40 sec; and when surface plastic strain of not less than 0.3% and not more than 1.5% is imparted to a steel strip at not less than 450° C. and less than 600° C., the steel strip is preferably moved to the sink roll within 120 sec. That is, according to such conditions, the surface residual plastic strain of the steel strip by the sink roll can be securely made to be 0.1% or more.

TABLE 1

| t(sec) | T(° C.) | A0 (%) | A (%) |
|---|---|---|---|
| 10 | 650 | 0.1 | 0.038 |
| 120 | 500 | 0.1 | 0.090 |
| 10 | 600 | 0.1 | 0.082 |
| 5 | 500 | 0.1 | 0.100 |
| 5 | 650 | 0.1 | 0.061 |
| 1 | 700 | 0.1 | 0.062 |
| 20 | 500 | 0.1 | 0.098 |

The inventors have obtained a finding that even if same amount of strain is imparted, there are cases with and without occurrence of the buckling depending on the elapsed time after the strain impartation to the roll where the buckling essentially tends to occur, such as the support roll located at the downstream side of the sink roll. From this, it is considered that as the dislocation increases, which is remained in the steel strip immediately before the temperature range in which the buckling occurs, the buckling is prevented more advantageously. It is also understood from that freely movable dislocation (movable dislocation) increases in proportion to the amount of the residual strain, and the movable dislocation is responsible for continuous plastic transformation (or the buckling is hard to occur).

Since the elongation percentage imparted to the steel strip in JP-A-10-130801 is not the amount of strain at the position where the buckling occur, in certain elapsed time from imparting strain or temperature of the steel strip, no strain remains at a point when the buckling occurs, therefore the buckling can not be prevented. In addition, since the elongation percentage is the average strain amount in a thickness direction, and is not surface plastic strain of the steel strip that is effective for preventing the buckling, the buckling can not be securely prevented by the elongation percentage.

The lateral warp of the steel strip 1 occurred at the wiper 8 portion in FIG. 4 is influenced most largely by the residual strain given by the roll at the downstream side. Therefore, the lateral warp is influenced most largely by the plastic strain given by the sink roll 6, next influenced largely by the plastic strain given by the roll at the most downstream side of the strain imparting device 21. The direction of the warp of the steel strip 1 is determined according to which plastic transformation of tension or compression is given to the both sides of the steel strip 1. Accordingly, it is enough to reduce the warp of the steel strip 1 occurred at the wiper 8 portion that the direction of the plastic strain given by the sink roll 6 is inverted with the direction of the plastic strain given by the roll at the most downstream side of the strain imparting device 21.

While the above is a case that the support roll is not present, in the case that the support roll is present, since the support roll is present at the downstream side of the sink roll, the strain imparted by the support roll largely influences on the warp of the steel strip occurred at the wiper portion. However, it is not preferable to impart large strain by the support roll for preventing the warp of the steel strip, because defects may be increased.

To prevent the lateral warp of the steel strip 1 in the wiper 8 portion, as described above, it is necessary to impart the surface plastic strain to the steel strip 1. At that time, the required pushing amount of the roll is determined as follows. In addition to relations between conditions of the steel strip 1 such as material or thickness, and temperature, spaces along the path line among respective rolls, the outer diameter, and the pushing amount, and the amount of surface plastic strain, relations between the above conditions of the steel strip 1 and the amount of warp at the wiper 8 portion are previously obtained, and a correlation table between the above conditions of the steel strip 1 and the pushing amount of the roll, which is compatible with the prevention of the lateral warp by the amount of the surface plastic strain, is previously prepared, and the pushing amount of the roll by which the buckling can be prevented is determined based on the correlation table. Also when the outer diameter of the sink roll 6 is increased, such correlation table is prepared.

As described above, JP-A-2000-204460 describes the correction of the warp of the metal strip using a pushing roll. However, since the support roll is provided in the molten metal bath, a problem due to the support roll occurs. Moreover, the warp of the metal strip is corrected by combined use of the support roll with the pushing roll, therefore it is essentially different from the warp correction method of the invention. Furthermore, the sink roll is not present in the molten metal bath, it is difficult to impart tension force stably to the metal strip, and surface plastic strain can not be imparted stably as required.

When the support roll is not installed in the molten zinc bath, the outer diameter of the sink roll may be larger than that in the case that the support roll is installed.

Figure 9:
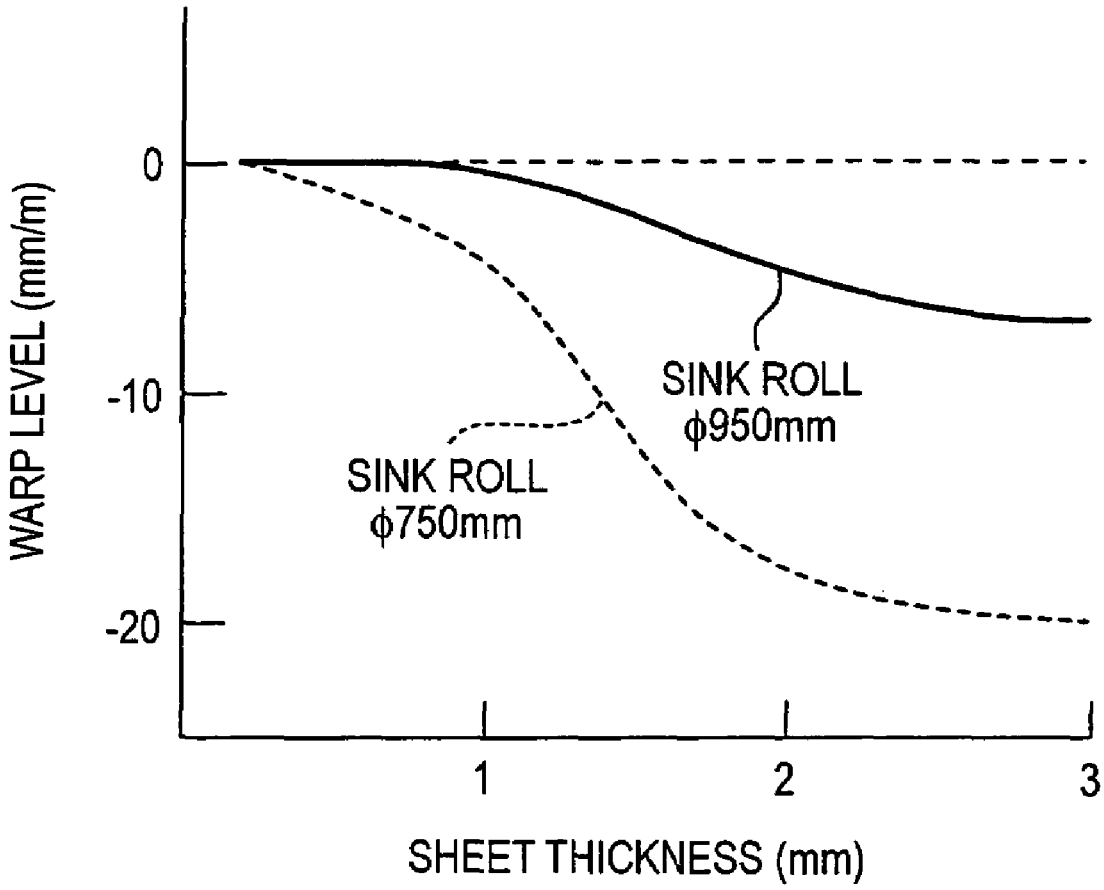
FIG. 9 is a view showing a relation between diameter of a sink roll and the amount of lateral warp of a steel strip.

FIG. 9 shows a relation between the outer diameter of the sink roll and the amount of lateral warp of the steel strip. The amount of warp is measured in the wiper portion of the steel strip 1200 mm in width, in which the sign is "+" when the warp is convex to a sink roll side, and "−" when it is convex to a side opposite to the sink roll side.

If a generally used sink roll having an outer diameter of 750 mm is exchanged to a sink roll having a larger diameter of 950 mm, bending stress imparted to the steel strip can be reduced, therefore the lateral warp of the steel strip can be reduced. Therefore, it is possible to flatten the steel strip having a large thickness for which warp correction has been difficult heretofore. From this viewpoint, the outer diameter of the sink roll is preferably made to be 850 mm or more.

The sink roll is preferably arranged such that a distance between the top of the roll and a surface of the molten zinc bath is 50 to 400 mm. This is because when the distance is less than 50 mm, the bath surface is stirred by the rotation of the sink roll and a large amount of top dross is produced, and when it is more than 400 mm, a deep molten zinc bath chamber is required, causing increase in facility cost.

In the hot-dipping steel strip production apparatus of the invention shown in FIG. 4, the steel strip 1 is imparted with the plastic strain by the strain imparting device 21, and then drawn into the molten zinc bath 5 through the snout 3, and then turned around by the sink roll 6, and then drawn up from the molten zinc bath 5, and then plating weight is controlled by the wiper 8, and then the steel strip 1 is cooled directly or after alloying of the plating layer in alloying furnaces 14, thereby a desired galvanized steel strip is formed. According to the apparatus, a galvanized steel strip can be produced, in which the buckling or splash does not occur, and the plating weight is laterally uniform, in addition, since the support roll is removed from the molten zinc bath in the example in FIG. 4, problems such as quality defects due to the support roll and shutdown of equipment for changing the rolls are solved. In the apparatus, a spangle adjustor may be provided instead of the alloying furnace 14 for spangle adjustment.

Figure 10:
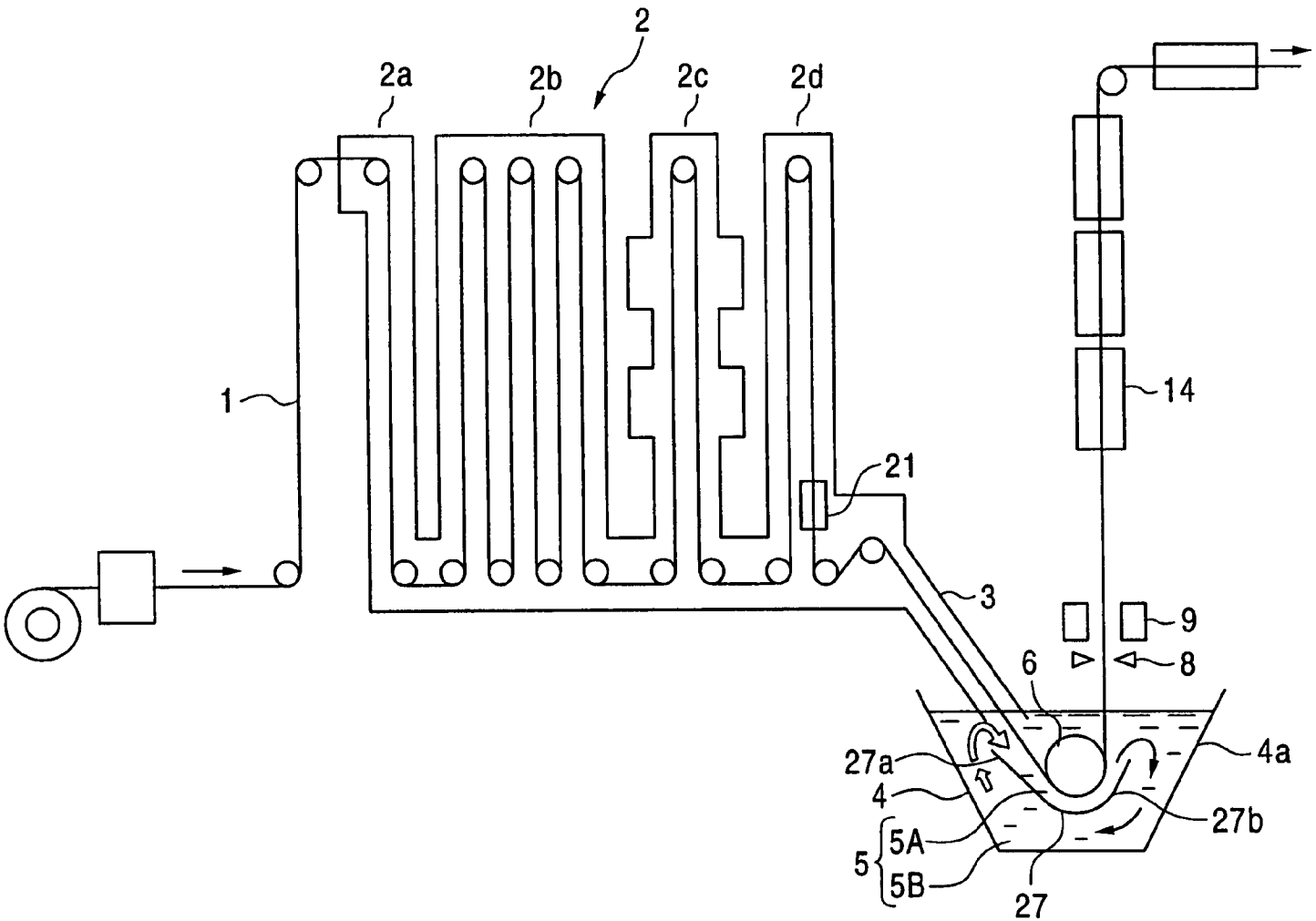
FIG. 10 is a view showing another example of the hot-dip plated metal strip production apparatus of the present invention.

FIG. 10 shows another example of the hot-dipping steel strip production apparatus of the invention. The example is a case that the support roll is removed, and the warp at the sink roll is corrected using the electromagnet, in addition, an enclosing member is provided.

The enclosing member 27 is opposed to a face of the steel strip 1 drawn into the molten metal bath 5; provided such that it encloses the face of the steel strip 1; divides the molten zinc bath 5 into an upper area 5A and a lower area 5B; and permits flow of the molten zinc between the upper area 5A and the lower area 5B. That is, the enclosing member 27 is a molten zinc chamber having an opened top provided in the molten zinc bath 5. Since the top is opened, the molten zinc in the chamber is flown out along with movement of the steel strip 1 and molten zinc is flown in from an outside of the chamber, and thus flow of the molten zinc is formed.

An upper end of the enclosing member 27 is located below a bath surface of the molten zinc bath 5, and an end 27*b* of the enclosing member 27 at a drawing-up side of the steel strip is located above a shaft core of the sink roll 6. The enclosing member 27 is disposed such that a distance to an underside of the steel strip 1 is at minimum directly under the sink roll 6.

The enclosing member 27 is made of stainless steel that may stand use of the high-temperature molten zinc. A leg-like supporting member (not shown) is installed on a lower portion of the enclosing member 27, and the enclosing member 27 is placed can be easily disposed on a bottom of the molten zinc bath chamber 4 through the supporting member. Accordingly, the enclosing member 27 can be easily disposed in the molten zinc bath chamber 4 and easily removed out of the molten zinc bath chamber 4.

Arrows around the enclosing member 27 in FIG. 10 show flow of the molten zinc. The black arrows show molten zinc with dross, and the white arrows show molten zinc in which the dross is precipitated and removed and thus cleaned. The molten zinc in the upper area 5A of the enclosing member 27 is flowed out beyond the end 27*b* of the enclosing member 27 at a drawing-up side of the steel strip 1 into the lower area 5B along with the movement of the steel strip 1. In an area below the sink roll 6 in the upper area 5A, since accompanying flow exists due to rotation of the sink roll 6, the flow of the molten zinc is maintained even in an area where the steel strip is not passing. In the upper area 5A, Fe is liquated from the steel strip 1, and fine Fe—Zn based dross is produced. Although the fine dross partially adheres on the steel strip 1, there is no problem in quality. The fine dross that has not adhered on the steel strip 1 is promptly discharged beyond the end 27*b* of the enclosing member 27 at the drawing-up side of the steel strip 1 into the lower area 5B with the flow accompanied with the steel strip 1, and does not precipitate and deposit in the upper area 5A. In the lower area 5B, molten zinc containing the flowed-in fine dross flows downward along a sidewall 4*a* at a drawing-up side of the steel strip 1 of the molten zinc bath chamber 4, and then flows along the enclosing member 27 to a drawing-in side (snout 3 side) of the steel strip 1 of the molten zinc bath chamber 4. Since the lower area 5B has a large capacity compared with the upper area 5A, and is not directly influenced by the accompanying flow of the steel strip 1 in the upper area 5A, the molten zinc flows slowly. Therefore, while the molten zinc flowed into the lower area 5B flows to the drawing-in side of the steel strip 1, the dross contained in the molten zinc precipitates on the bottom of the molten zinc bath chamber 4. The dross precipitated and deposited on the bottom of the molten zinc bath chamber 4 gathers and grows into large dross 16 that affects on quality of the steel strip 1. Since flow is slow in the lower portion 5B, the large dross 16 deposited on the bottom of the molten zinc bath chamber 4 is hardly coiled up even if the conveyance speed of the steel strip 1 is varied, or even if the dross is coiled up, the dross promptly precipitates on the bottom of the molten zinc bath chamber 4. Therefore, the molten zinc bath 5 is clean in the area at the drawing-in side of the steel strip 1 in the lower area 5B. Particularly, a supernatant bath on top of the bath surface is further clean, and the large dross 16 that influences on the quality of the steel strip 1 does not float.

The cleaned supernatant bath in the molten zinc bath 5 flows into the upper area 5A beyond the end 27*a* of the enclosing member 27 at the drawing-in side of the steel strip 1 with the accompanying flow of the steel strip 1. The steel strip 1 is drawn from the snout 3 into the molten zinc bath 5, turned around in the upper area 5A by the sink roll 6 with accompanying the cleaned molten zinc bath 5, and then drawn up from the molten zinc bath 5. While the steel strip 1 is drawn into the molten zinc bath 5 and drawn up from the molten zinc bath 5, the dross 16 influencing on the quality is not present in the movement area of the steel strip 1, therefore the steel strip 1 without the adhered dross can be produced.

The enclosing member 27 is preferably installed such that the proximal distance to the steel strip 1 is 50 to 400 mm. This is because when the distance is less than 50 mm, the member may contact with the steel strip 1 due to thermal deformation, or positioning is difficult in installing the enclosing member 27, and when the distance is more than 400 mm, an area is generated in the enclosing member 27, in which influence of the accompanying flow of the steel strip 1 does not appear, and the dross produced in the enclosing member 27 can not be discharged into the lower area 5B and deposits within the enclosing member 27.

The enclosing member 27 may be installed such that its upper end is above the surface of the molten zinc bath. In this case, in a portion of the end 27*a* of the enclosing member 27 on the bath surface at the drawing-in side of the steel strip 1, or in a portion in the bath close to the bath surface, an opening for flowing the molten zinc in the lower area 5B into the upper area 5A is installed. Alternatively, in a portion of the end 27*b* of the enclosing member 27 on the bath surface at the drawing-up side of the steel strip 1, or in a portion in the bath close to the bath surface, an opening for flowing out the molten zinc in the upper area 5A into the lower area 5B may be installed. However, when the enclosing member 27 is above the bath surface, operation of removing the top dross produced on the bath surface in the enclosing member 27 out of the molten zinc bath chamber 4 is complicated; and the top dross adheres on the enclosing member 27, the accompanying flow with the steel strip 1 may, flow out the molten zinc in the upper area 5A into the lower area 5B, and may flow the clean molten zinc from the lower area 5B into the upper area 5A; therefore the upper end of the enclosing member 27 is preferably installed below the bath surface. When the upper end of the enclosing member 27 is less than 100 mm below the bath surface, the accompanying flow with the steel strip 1 stirs the bath surface and thus increases the amount of produced top dross, therefore the upper end is preferably made to be not less than 100 mm below the bath surface.

To prevent that the accompanying flow with the steel strip 1 in the upper area 5A influences on an inside of the lower area 5B, and coils up the dross deposited on the bottom of the molten zinc bath chamber 4, the upper end of the enclosing member 27 must be above the shaft core of the sink roll 6, more preferably above the utmost portion of the sink roll 6.

Compared with the apparatus shown in FIG. 4, the apparatus shown in FIG. 10 is excellent because of the function of suppressing the dross adhesion, therefore even if the conveyance speed of the steel strip 1 is not decreased, or even if production efficiency is not reduced, a high-quality galvanized steel strip without the dross adhesion can be produced.

In the upper area 5A, the molten zinc in the molten zinc bath chamber 4 is flowed from the drawing-in side of the steel strip 1 to the drawing-up side of the steel strip 1 with the accompanying flow with the steel strip 1, and flowed out into the lower area 5B beyond the end 27*b* of the enclosing member 27 at the drawing-up side of the steel strip 1. In the lower area 5B, the molten zinc flows downward along the sidewall 4*a* of the molten zinc bath chamber 4 at the drawing-up side of the steel strip 1, and flows into the drawing-in side of the steel strip 1 through an underside portion and a side face of the enclosing member 27, or flows in a direction opposite to the direction in the upper area 5A. In this way, the molten zinc circulates between the upper area 5A and the lower area 5B, however, driving force of the molten zinc circulation is caused by the accompanying flow with the passing steel strip 1, and equipment for the circulation such as a pump is unnecessary, therefore there is an advantage that facility can be simple and inexpensive. The dross deposited on the bottom of the lower area 5B or the bottom of the molten zinc bath chamber 4 may be removed by removing the enclosing member 27 out of the molten zinc bath chamber 4, and then using conventionally known means.

Figure 11:
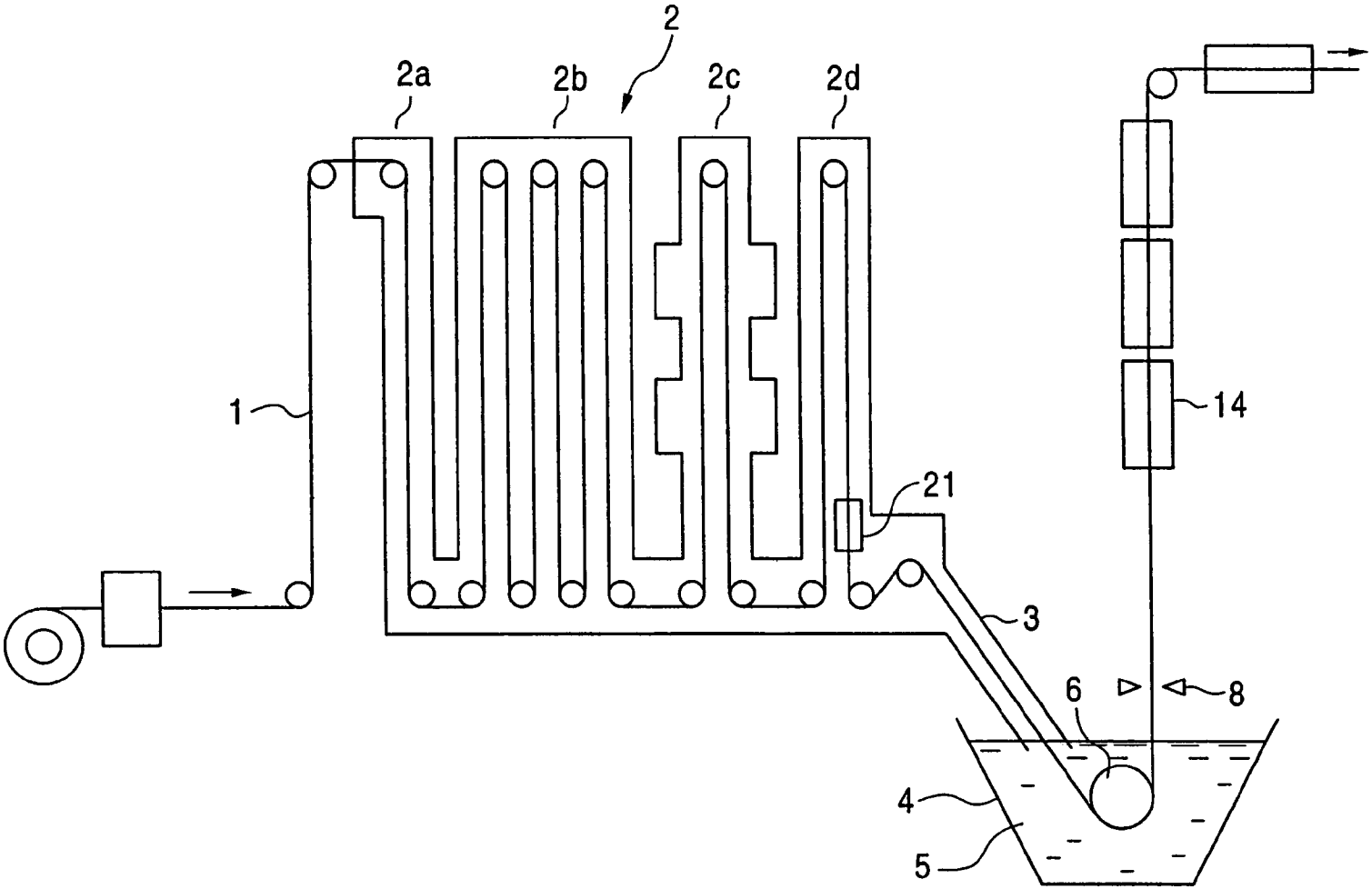
FIG. 11 is a view showing another example of the hot-dip plated metal strip production apparatus of the present invention.

FIG. 11 shows another example of the hot-dipping steel strip production apparatus of the invention.

This apparatus is an apparatus in which the shape correcting means 9 is removed from the apparatus in FIG. 4. Although both of the support roll and the shape correcting means are not present; if the roll 24 at the most downstream side of the strain imparting device 21 is disposed such that the roll contacts with the surface opposite to the surface on which the sink roll 6 contacts with the metal strip 1 as shown in FIG. 6 and the pushing amount of the roll is controlled, the lateral warp of the steel strip 1 can be made substantially zero in the wiper 8 portion. At that time, the pushing amount of the roll 24 needs to be controlled such that the amount of the surface residual plastic strain of the metal strip 1 caused by the roll 24 is smaller than the amount of the surface plastic strain of the metal strip 1 caused by the sink roll, however, when the amount is too small (the residual amount is 0.05% or less), the warp given by the sink roll can not be cancelled.

Figure 12:
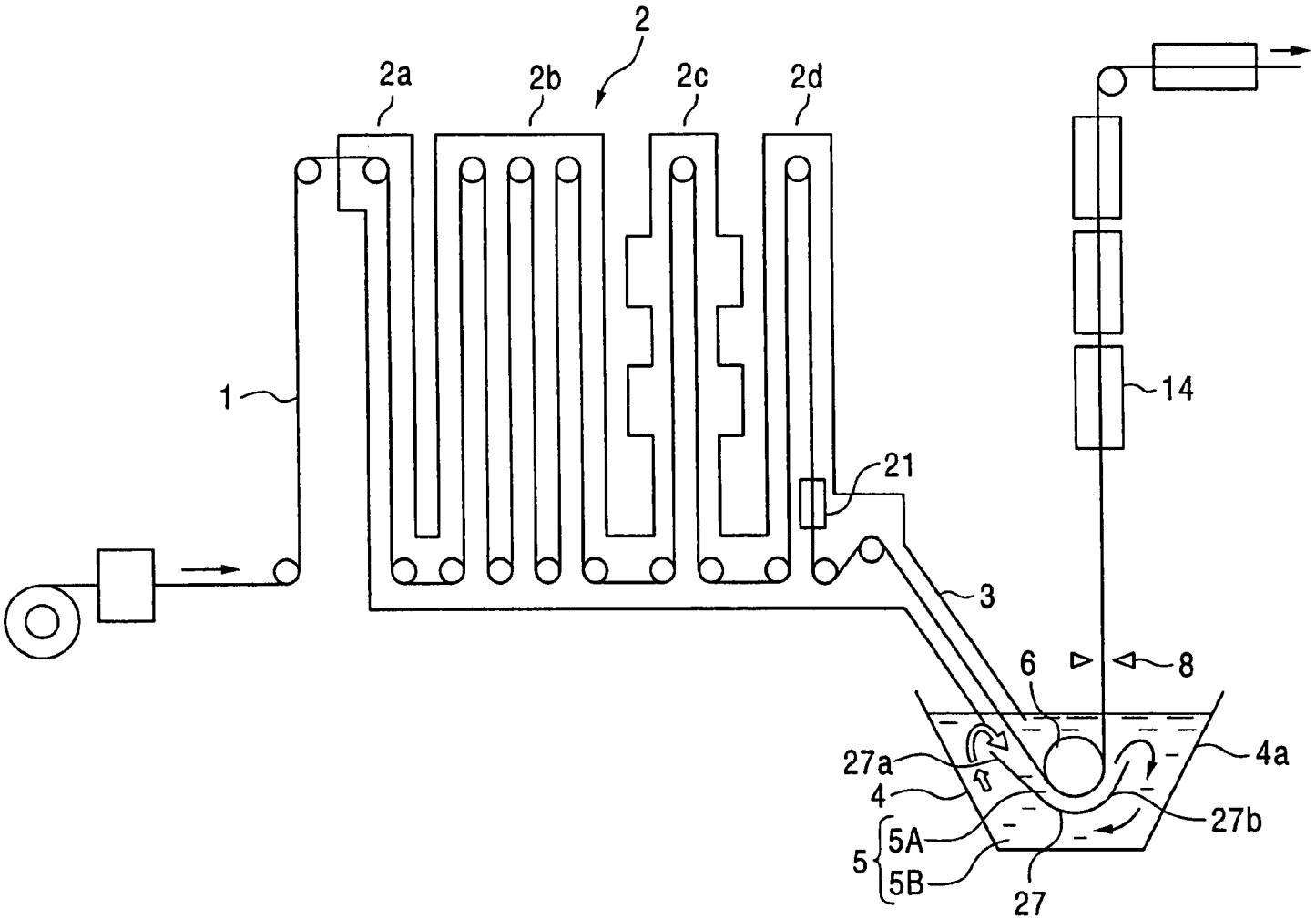
FIG. 12 is a view showing another example of the hot-dip plated metal strip production apparatus of the present invention.

FIG. 12 shows another example of the hot-dipping steel strip production apparatus of the invention.

This apparatus is an apparatus in which the enclosing member 27 shown in FIG. 10 is added in the molten metal bath chamber 4 in the apparatus in FIG. 11. The enclosing member 27 provides a merit that the dross adhesion is more perfectly prevented compared with the apparatus in FIG. 11.

Figure 13:
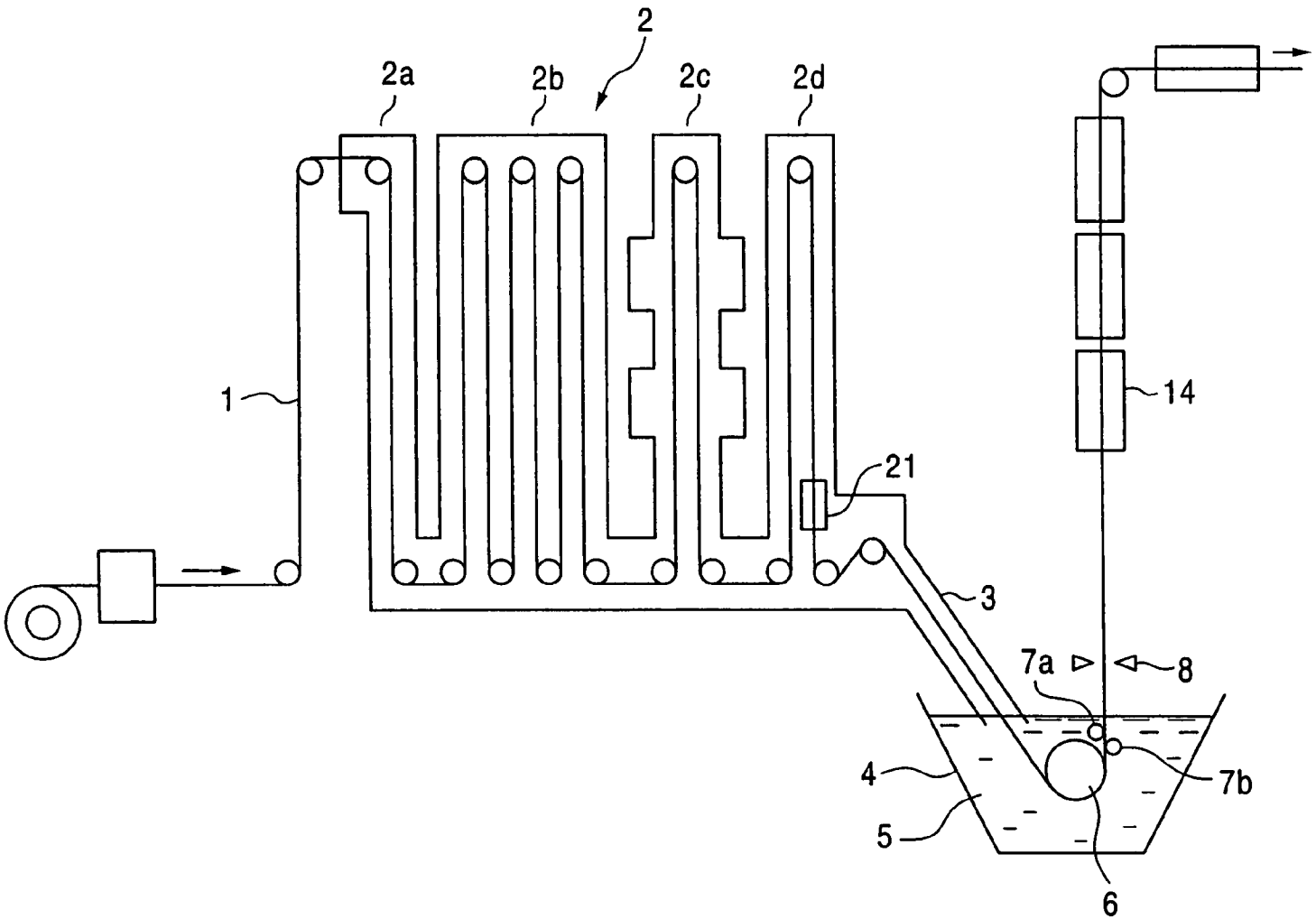
FIG. 13 is a view showing another example of the hot-dip plated metal strip production apparatus of the present invention.

FIG. 13 shows another example of the hot-dipping steel strip production apparatus of the invention. This example is a case with employing the support roll and without employing the electromagnet.

In this apparatus, the support roll 7 (7*a*, 7*b*) is added in the molten metal bath chamber 4 in the apparatus in FIG. 11. Therefore, the warp to be occurred at the sink roll 6 can be cancelled and the lateral warp of the steel strip 1 at the wiper 8 portion can be reduced, in addition, the strain imparting function of the support roll 7 is displayed, thereby the buckling can be suppressed even in the case of a steel type or an operation condition in which the buckling is apt to occur. At that time, since the warp correction by the support roll 7 need not be considered, the pushing amount can be reduced. Therefore, increase of defects by pushing the dross, or increase of maintenance cost due to roll abrasion can be prevented.

Although the support roll 7 is added to the apparatus in FIG. 11 in this example, the strain imparting device 21 need not be operated in such a condition that the warp occurred at the sink roll 6 is cancelled in any case. That is, just by adding the strain imparting function of the strain imparting device 21 to the warp correcting function and strain imparting function of the support roll 7, a condition can be selected, wherein the buckling scarcely occur, while the problems due to the support roll 7 occur as ever.

As the material for the galvanized steel strip, a hot-rolled steel strip that has been descaled after hot rolling and a cold-rolled steel strip obtained by, cold-rolling the hot-rolled steel strip can be used. The galvanized steel strip using the cold-rolled steel strip as a material is often used for an application required for good surface appearance such as an automobile outside plate, and the galvanized steel strip produced in the method of the invention is suitable for such application.

EXAMPLE

Using the galvanized steel strip production apparatus shown in FIG. 10, cold-rolled steel strips 0.75 mm in thickness and 1200 mm in width, which are produced using steels a to e having chemical compositions shown in Table 2, were annealed in line speed of 120 mpm, tensile force of 2 kg/mm$^2$, and temperature of 850° C., and then imparted with strain in conditions shown in table 3 by the strain imparting device, and then immersed in the molten zinc bath at 460° C., and then drawn up from the molten zinc bath; and gas pressure of the wiper was adjusted such that the coating weight for one side of the steel strip is 45 g/m$^2$ while the shape of steel strip was corrected in a noncontact manner by the shape correcting means; and then temper rolling having a rolling rate of 1.2% was done, consequently galvanized steel strips 1 to 15 were produced. Here, the galvanized Steel strip 1 was not imparted with strain by the strain imparting device, and had the tensile properties before the temper rolling of upper yield point of 25 kg/mm$^2$, lower yield point of 22 kg/mm$^2$, and yield point elongation of 4.3%, and the temperature at which the yield point elongation disappeared (threshold temperature T1) was 440° C.

Figure 14:
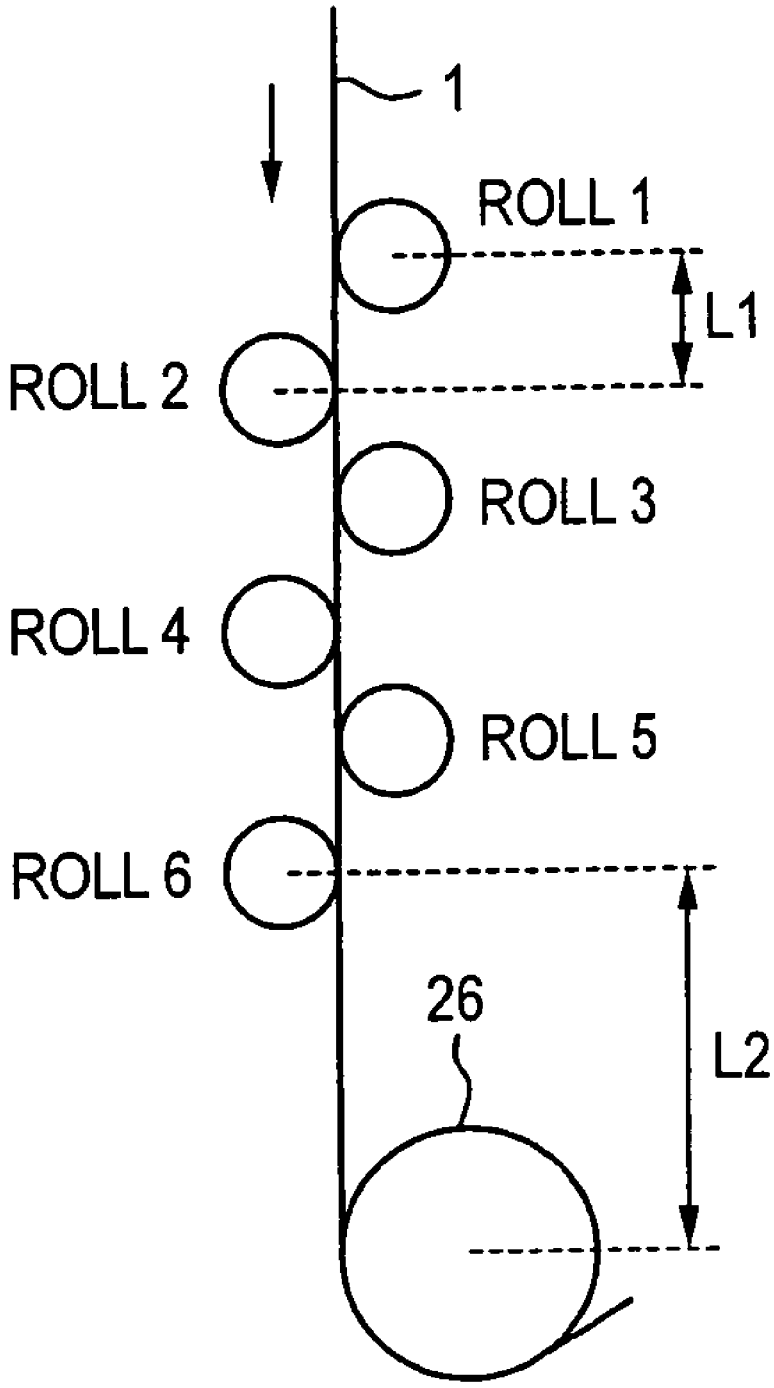
FIG. 14 is a view showing an example of roll arrangement in the strain imparting device.

As the strain imparting device, a device having six rolls (rolls 1 to 6) shown in FIG. 14 was used, and the imparted strain amount was varied according to the following conditions. Each of intervals L1 among adjacent rolls along the path line was 300 mm, and an interval L2 between the roll 6 and the hearth roll 26 was 1000 mm. The outer diameter of the hearth roll 26 was 1000 mm.

A case of 2 rolls: Rolls 1, 2, 4, and 5 were not used, and a roll having an outer diameter of 1000 mm as the roll 3 and a roll having an outer diameter of 100 mm as the roll 6 are disposed, and the roll 6 was pushed in a direction substantially perpendicular to the path line, thereby the strain was imparted. The roll 6 was reinforced by a backup roll having an outer diameter of 400 mm from a point of roll stiffness.

A case of 3 rolls: Rolls 1 to 3 were not used, the roll 6 was disposed on the path line, and the roll 4 and the roll 5 were pushed into displaced positions from the path line as shown in FIG. 7B, there by the strain was imparted. A roll having an outer diameter of 250 mm or outer diameter of 1000 mm was used for the rolls 4 to 6. When the roll having an outer diameter 1000 mm was used, respective rolls were reinforced by the backup roll having the outer diameter of 400 mm from the point of roll stiffness.

A case of 5 rolls: The roll 1 was not used, three rolls 2, 4, and 6 having the outer diameter of 250 mm were disposed on the path line, and in respective middle positions among these rolls, the rolls 3 and 5 were disposed oppositely across the steel strip, and the rolls 3 and 5 were pushed in a direction substantially perpendicular to the path line, thereby the strain was imparted.

A case of 6 rolls: The rolls 1 to 6 having the outer diameter of 250 mm were disposed as shown in FIG. 14, and the rolls 1, 3, and 5 were pushed in a direction substantially perpendicular to the path line, thereby the strain was imparted.

The diameter of the sink roll is 950 mm.

Above the wiper provided for wiping the surplus zinc, the shape correcting means shown in FIG. 5 is installed at a position 20 mm away from the path line. In the shape correcting means, electric current for the electromagnet is controlled according to the amount of transformation of, the steel strip measured by a laser displacement meter in order to eliminate the warp of the steel strip in the wiper portion. In the steel strip 3 in Table 3, the warp is not corrected by the shape correcting means.

The enclosing member installed in the molten zinc bath has a shape accommodated to the sink roll, and has a minimum space of 100 mm to the steel strip.

The enclosing member was removed from the apparatus in FIG. 10, and a galvanized steel strip 16 was produced in addition to such steel strips 1 to 15 using the steel d in Table 2. As a conventional example, a galvanized steel strip 17 was produced using the steel e in Table 2 and using the conventional production apparatus shown in FIG. 1, in which the support roll is present in the molten zinc, and the strain imparting device, shape correcting means, or enclosing member is not present.

For these steel strips 1 to 17, lateral deviation of the coating weight, presence of the dross, and level of the buckling were evaluated.

Regarding the level of the buckling, a press test simulated the press of an automobile door panel was conducted, and then the buckling was visually observed and evaluated in 6 stages of 0 to 5 according to the level of the buckling. Here, the buckling level is best at 0 (no occurrence), and becomes worse as the number increases. It is desirable that the buckling level is not more than 1 in the application of the automobile outside panel, and not more than 2 in the application of the automobile inside panel.

Table 3 shows results of the buckling level.

In the steel strips 2 and 4 to 15 that are the examples of the invention in which the strain was imparted and the warp was corrected by the shape correcting means, the lateral deviation of the coating weight was about ±5 g/m$^2$, and in the steel strip 3 that was the example of the invention in which the strain was imparted, but the warp was not corrected, the lateral deviation of the coating weight was about ±10 g/m$^2$. Moreover, presence of the dross on the surface of the steel strip was confirmed using a 300 mm square sample, as a result the dross was not confirmed in either condition.

While the buckling level was 5, or bad, in the steel strip 1 of the comparative example to which the strain was not imparted, the steel strips 2 to 15, in which the strain imparting conditions are within the scope of the invention, have a buckling level of not more than 2, which is slight in such a degree that the buckling defect is not a practical issue. Actually, the press test of an automobile door was performed, as a result no defect due to the buckling was found for the buckling level 0 and 1, and the defects were extremely slight for the buckling level 2.

In the steel strip 16 that is the example of the invention, which was produced without installing the enclosing member, the lateral deviation of the coating weight was about ±5 g/m$^2$; and a surface of the steel sheet was observed using the 300 mm square sample, as a result the number of the dross was about 5. The buckling defect was not found.

In the steel strip 17 that is the conventional example, the lateral deviation of the coating weight was about ±10 g/m$^2$ and a surface of the steel sheet was observed using the 300 mm square sample, as a result the number of the dross was about 5. The buckling defect in the buckling level of 4 was found over the entire surface of the steel strip, and further deteriorated buckling defect was confirmed after the press test.

In the steel strip 3, the strain impartation was set such that the strain was able to cancel the warp at the sink roll, however, the deviation of the coating weight was about ±10 g/m$^2$ in each roll, which was almost equal to the conventional one. It is known from that that there is a similar warp correction effect in the example of the invention as in the conventional support roll.

TABLE 2

| steel | C | Si | Mn | P | S | Sol.Al | N | Nb | Ti |
|---|---|---|---|---|---|---|---|---|---|
| | | | | | | | | (Mass %) | |
| a | 0.0014 | 0.01 | 0.61 | 0.031 | 0.006 | 0.053 | 0.0017 | 0.006 | 0.006 |
| b | 0.0025 | 0.01 | 0.37 | 0.034 | 0.005 | 0.042 | 0.0028 | 0.010 | 0.005 |
| c | 0.0018 | 0.01 | 0.50 | 0.034 | 0.015 | 0.053 | 0.0017 | 0.006 | 0.004 |
| d | 0.0020 | 0.01 | 0.46 | 0.031 | 0.010 | 0.050 | 0.0020 | 0.006 | 0.006 |
| e | 0.0015 | 0.02 | 0.65 | 0.040 | 0.006 | 0.062 | 0.0022 | 0.007 | 0.003 |

TABLE 3

| | | Strain imparting conditions | | | | | | |
|---|---|---|---|---|---|---|---|---|
| Steel strip | Steel | Steel strip Temperature (° C.) | Number of rolls | Outer Diameter of roll (mm) | Total of Surface plastic strain (%) | Maximum radius of curvature of steel strip (mm) | Buckling level | Remarks |
| 1 | a | — | — | — | — | — | 5 | Comparative example |
| 2 | a | 500 | 3 | 250 | 0.8 | 136 | 0 | Inventive example |
| 3 | a | 500 | 3 | 250 | 0.8 | 136 | 0 | Inventive example |
| 4 | a | 550 | 3 | 250 | 0.8 | 140 | 0 | Inventive example |
| 5 | a | 600 | 3 | 250 | 0.8 | 142 | 1 | Inventive example |
| 6 | a | 700 | 3 | 250 | 0.8 | 148 | 2 | Inventive example |
| 7 | a | 400 | 3 | 250 | 0.8 | 130 | 2 | Inventive example |
| 8 | b | 500 | 2 | 100, 1000 | 0.8 | 91 | 0 | Inventive example |
| 9 | a | 500 | 5 | 250 | 0.8 | 176 | 2 | Inventive example |
| 10 | a | 500 | 6 | 250 | 0.8 | 190 | 2 | Inventive example |
| 11 | a | 500 | 3 | 250 | 0.05 | 390 | 2 | Inventive example |
| 12 | a | 500 | 3 | 250 | 0.3 | 136 | 0 | Inventive example |
| 13 | c | 500 | 3 | 1000 | 1.2 | 102 | 0 | Inventive example |
| 14 | c | 500 | 3 | 1000 | 1.6 | 81 | 1 | Inventive example |
| 15 | c | 500 | 3 | 1000 | 2.0 | 70 | 2 | Inventive example |
| 16 | d | 500 | 3 | 250 | 0.8 | 136 | 0 | Inventive example |
| 17 | e | — | — | — | — | — | 4 | Conventional example |

The invention claimed is:

1. A method for producing a hot-dip plated metal strip comprising the steps of:

annealing a metal strip;

imparting a surface plastic strain to the metal strip using plural rolls, by bending;

drawing the metal strip into a molten metal bath for plating;

turning around the metal strip upward with adhered molten metal on the metal strip, and then drawing up the metal strip out of the molten metal bath without contacting the metal strip with a roll in the molten metal bath; and controlling a coating weight of the molten metal adhered on the metal strip using a wiper;

wherein the step of imparting surface plastic strain comprises imparting the surface plastic strain such that an amount of surface residual plastic strain is 0.1% or more which remains on a surface of the metal strip at a point when the metal strip arrives at a sink roll.

2. The method according to claim 1, wherein a roll located at the most downstream side in the plural rolls is disposed at a side of an opposite surface to a surface of the metal strip that contacts with the sink roll.

3. The method according to claim 1, wherein a roll located at the most downstream side in the plural rolls imparts an amount of the surface residual plastic strain of not less than 0.05% to the metal strip.

4. The method according to claim 3, wherein an amount of the surface plastic strain of the metal strip imparted by the sink roll is made to be smaller than the amount of the surface residual plastic strain of the metal strip imparted by the roll located at the most downstream side.

5. The method according to claim 1, further comprising the step of correcting a shape of the metal strip in a noncontact manner by magnetic force immediately before and after the wiper.

6. The method according to claim 5, wherein in the step of imparting the plastic strain to the metal strip, the metal strip is imparted with the surface plastic strain using the plural rolls by the bending, the metal strip is turned around by the sink roll in the molten metal bath, and a roll located at the most downstream side in the plural rolls is disposed at a side of an opposite surface to the surface of the metal strip that contacts with the sink roll.

7. The method according to claim 5, wherein the plastic strain is imparted to the metal strip by the bending in a temperature range where the temperature of the metal strip is 450 to 650° C. after arriving at a peak temperature during the annealing.

8. The method according to claim 7, wherein the bending is performed using at least one roll such that the amount of the surface plastic strain of the metal strip is more than 0.1% and not more than 1.5%.

9. The method according to claim 8, wherein at least two rolls are used, and the amount of the surface plastic strain of the metal strip imparted by a roll at the most downstream side in the plural rolls is made to be smaller than an amount of surface plastic strain of the metal strip imparted by a roll at an upstream side of the roll at the most downstream side.

10. The method according to claim 5, wherein an enclosing member is provided in the molten metal bath such that the enclosing member encloses the metal strip, thereby a flow of molten metal located above and below the enclosing member is permitted.

11. The method according to claim 1, wherein a roll located at the most downstream side in the plural rolls imparts an amount of the surface residual plastic strain of 0.05% or more to the metal strip.

12. The method according to claim 11, wherein the amount of the surface plastic strain of the metal strip imparted by the sink roll is made to be smaller than the amount of the surface residual plastic strain of the metal strip imparted by the roll located at the most downstream side.

13. A method for producing a hot-dip plated metal strip comprising the steps of;

annealing a metal strip;

imparting a surface plastic strain to the metal strip using at least one surface strain imparting roll by bending after heating the metal strip to a peak temperature during the annealing and before drawing the metal strip into a molten metal bath for plating;

drawing the metal strip into the molten metal bath for dipping, and adhering the molten metal thereon; and turning around the metal strip by a sink roll, and then drawing up the metal strip out of the molten metal bath;

wherein the surface plastic strain is imparted to the metal strip such that surface residual plastic strain is 0.1% or more, which remains on a surface of the metal strip at a point when the metal strip arrives at the sink roll.

14. The method according to claim 13, wherein said at least one surface strain imparting roll comprises at least two surface strain imparting rolls;

said at least two surface strain imparting rolls have a downstream side roll located at the most downstream side in the at least two surface strain imparting rolls;

said downstream side roll is disposed at the side of an opposite surface to a surface of the metal strip that contacts with the sink roll in the molten metal bath.

15. The method according to claim 14, wherein the amount of the surface plastic strain of the metal strip imparted by the sink roll is made to be smaller than the amount of the surface residual plastic strain of the metal strip imparted by the roll located at the most downstream side.

16. The method according to claim 14, wherein the roll located at the most downstream side imparts an amount of the surface residual plastic strain of not less than 0.05% to the metal strip.

17. The method according to claim 16, wherein the plastic strain is imparted to the metal strip in a temperature range where the temperature of the metal strip is 450 to 650° C. after arriving at a peak temperature during the annealing.

18. A method for producing a hot-dip plated metal strip comprising the steps of:

annealing a metal strip;

imparting a surface plastic strain to the metal strip using at least one surface strain imparting roll by bending after heating the metal strip to a temperature which is a peak temperature during the annealing and before drawing the metal strip into a molten metal bath for plating;

drawing the metal strip into the molten metal bath for the plating, and adhering the molten metal on the metal strip;

and turning around the metal strip by a sink roll, and then drawing up the metal strip out of the molten metal bath, wherein said at least one surface strain imparting roll comprises at least two surface strain imparting rolls;

said at least two surface strain imparting rolls have a downstream side roll located at the most downstream side in the at least two surface strain imparting rolls;

said downstream side roll is disposed at a side of an opposite surface to a surface of the metal strip that contacts with the sink roll in the molten metal bath; and the roll located at the most downstream side imparts an amount of the surface residual plastic strain of 0.05% or more to the metal strip.

19. The method according to claim 18, wherein the amount of the surface plastic strain of the metal strip imparted by the sink roll is made to be smaller than the amount of the surface residual plastic strain of the metal strip imparted by the roll located at the most downstream side.

20. The method according to claim 18, wherein a metal strip at 650° or more is imparted with a surface plastic strain of 1.5% or less, and then moved to the sink roll within 10 seconds.

21. The method according to claim 18, wherein a metal strip at not less than 600° C. and less than 650° C. is imparted with a surface plastic strain of not less than 0.35% and not more than 1.5%, and then moved to the sink roll within 40 seconds.

22. The method according to claim 18, wherein a metal strip at not less than 450° C. and less than 600° C. is imparted with a surface plastic strain of not less than 0.3% and not more than 1.5%, and then moved to the sink roll within 120 seconds.

* * * * *